US005578426A

United States Patent [19]

Nakamura

[11] Patent Number: 5,578,426

[45] Date of Patent: Nov. 26, 1996

[54] METHOD FOR PROCESSING A SILVER HALIDE COLOR PHOTOGRAPHIC MATERIAL

[75] Inventor: Koichi Nakamura, Minami-ashigara, Japan

[73] Assignee: Fuji Photo Film Co., Ltd., Kanagawa, Japan

[21] Appl. No.: 358,574

[22] Filed: Dec. 14, 1994

Related U.S. Application Data

[63] Continuation of Ser. No. 87,874, Jul. 9, 1993, abandoned.

[30] Foreign Application Priority Data

Jul. 15, 1992 [JP] Japan ..... 4-209460

[51] Int. Cl.[6] ..... G03C 7/392

[52] U.S. Cl. ..... 430/383; 430/489; 430/523; 430/525; 430/947; 430/950

[58] Field of Search ..... 430/359, 434, 430/435, 383, 486, 489, 523, 525, 947, 950, 963

[56] References Cited

U.S. PATENT DOCUMENTS

| | | | |
|---|---|---|---|
| 4,565,774 | 1/1986 | Kajiwara et al. | 430/382 |
| 5,004,676 | 4/1991 | Meckl et al. | 430/398 |
| 5,109,246 | 4/1992 | Yamamoto et al. | 354/318 |
| 5,151,345 | 9/1992 | Hasebe | 430/947 |
| 5,173,395 | 12/1992 | Asami | 430/376 |
| 5,176,987 | 1/1993 | Nakamura et al. | 430/351 |
| 5,206,120 | 4/1993 | Hayashi | 430/376 |
| 5,238,788 | 8/1993 | Kajiwara et al. | 430/357 |
| 5,364,748 | 11/1994 | Yoneyama | 430/950 |
| 5,368,996 | 11/1994 | Asami | 430/950 |
| 5,391,471 | 2/1995 | Ohshima et al. | 430/950 |

FOREIGN PATENT DOCUMENTS

| | | |
|---|---|---|
| 0438156 | 7/1991 | European Pat. Off. . |
| 59-177542 | 10/1984 | Japan . |
| 59-232342 | 12/1984 | Japan . |
| 2-234157 | 9/1990 | Japan . |
| WO-87045344 | 7/1987 | WIPO . |

*Primary Examiner*—Hoa Van Le

*Attorney, Agent, or Firm*—Sughrue, Mion, Zinn, Macpeak & Seas

[57] ABSTRACT

There is disclosed a method for processing a silver halide color photographic material having, on a support, at least one photosensitive silver halide emulsion layer, which comprises processing after exposure to light said silver halide color photographic material, wherein the silver halide in said emulsion layer contains 90 mol % or more of silver chloride, and said photographic material has a white pigment-containing hydrophilic colloid layer coated on the support, the coating amount of the white pigment being 2 g/m$^2$ or more, with a color developer containing chloride ions in an amount of 0.04 to 0.25 mol/l.

19 Claims, No Drawings

METHOD FOR PROCESSING A SILVER HALIDE COLOR PHOTOGRAPHIC MATERIAL

This is a continuation of application Ser. No. 08/087,874 filed Jul. 9, 1993, now abandoned.

FIELD OF THE INVENTION

The present invention relates to a method for processing silver halide color photographic materials, and more particularly to a method for processing silver halide color photographic materials wherein the sharpness of an image formed is high, the fluctuation of sensitivity during the processing is low, and the processing stability is excellent.

The present invention also relates to a method for processing silver halide color photographic materials that is suitable for a low-replenishment-rate processing whose amount of waste solution is small.

The present invention also relates to a method for processing silver halide color photographic materials that causes low image stain even if a processing of low replenishment-rate is carried out.

BACKGROUND OF THE INVENTION

The processing of silver halide photographic materials, such as a silver halide color photographic material, comprises a color-developing process and a desilvering process. In the desilvering process, developed silver produced in the color-developing process is oxidized (bleached) to a silver salt by a bleaching agent having an oxidation action, and it is removed from the photosensitive layers after it is changed together with unused silver halide into a soluble silver ions by a fixing agent (fixing). As the bleaching agent, a ferric(III) ion complex salt (e.g., an aminopolycarboxylic acid/ferric(III) complex salt) is mainly used, and as the fixing agent, a thiosulfate is generally used.

The bleaching and the fixing are carried out in some cases separately in a bleaching step and a fixing step, and in some cases they are carried out simultaneously in a bleach-fix step. Details of these processing steps are described by James in *The Theory of Photographic Process,* 4th edition (1977).

The above processing steps are generally carried out by an automatic processor. Particularly, in recent years, rapid-processing service for customers is spreading through the installation of small-sized automatic processors called mini-labs in shops. A bleaching agent and a fixing agent are used in one and the same bath, which acts as a bleach-fix bath in the processing of color paper; this enables an automatic processor to be small and makes the rapid processing.

Further, in order to save resources and to preserve the environment, low-replenishment-rate measures are being taken positively. However, if low-replenishment-rate measures for a developer are taken simply, the accumulation of substances dissolved from the photographic material, particularly iodide ions and bromide ions, which are strong development inhibitors, lowers the development activity, leading to the problem that the rapidness is spoiled. For the purpose of reducing the accumulation of iodide ions and bromide ions and for attaining a rapid process, methods wherein a silver halide photographic material high in silver chloride content is used, which methods are disclosed in JP-A ("JP-A" means unexamined published Japanese patent application) Nos. 95345/1983, 232342/1984, and 70552/1986 and WO 87-04534 are considered to be effective means that makes possible rapid processing under low-replenishment-rate of a developer. Other methods for rapid processing, in which the pH of a developer or the processing temperature is elevated are also known.

JP-A No. 443/1992 discloses a process that allows the storage stability of a color image to be excellent. It makes low-replenishment-rate possible, and it permits the process to be carried out ultra-rapidly by processing a silver halide photographic material high in silver halide content with a color developer containing, as a dolor-developing agent, a hydroxyalkyl-substituted p-phenylenediamine derivative having a specific structure.

Concerning a washing step or a stabilizing step, JP-A Nos. 214155/1991 and 233452/1991 disclose processes that make possible low-replenishment-rate by a multi-stage counter-current system and/or by reusing water that has been treated with a reverse osmosis membrane.

Thus, low-replenishment-rate is attempted in every processing step and it has become an important subject in recent years. It is known that, if the amount of washing water is reduced, the concentrations of iron salts and other salts in the washing bath increase and they remain on the photographic material, leading to the defect that the dye image deteriorates after long storage. However, the image quality of the processed sample is good and the defect is not fatal.

On the other hand, there is increased demand for higher image quality of color papers, and JP-A No. 177542/1984 discloses, as a method for enhancing sharpness, a method for improving sharpness of a photographic image by providing a hydrophilic colloid layer containing a white pigment on a paper support covered with synthetic resin film, to suppress the scattering of light on the support at the time of exposure.

However, when the above solid-dispersed substance was used in a high-silver-chloride photographic material that allowed rapid processing in order to improve sharpness of an image, first it became apparent that the fluctuation of the photographic sensitivity during the processing, due to a change of the processing conditions, increased. That is, when the processing was carried out at a higher processing temperature range, in order to perform a development process rapidly, a problem arose that the fluctuation of the photographic sensitivity during the processing, due to a change in temperature, increased.

Secondly, it was found that, when color development was effected with running solution with the replenishment rate being low and particularly when a washing step was also carried out with the replenishment rate being low, stain (coloring) was liable to occur on the processed image.

Thus, it is strongly desired to attain a processing method wherein the conventional high sharpness of an image is retained, the fluctuation of processing due to rapid processing is low, and/or an image with low stain is provided, even if the process is carried out with the replenishment rate being low.

The occurrence of stain referred herein will be further described. In the processing of a color photographic material, for the purpose of making the processing rapid with the replenishment rate being low and for making the processing simple, for example, if the running process is effected with the replenishment rate being low in the color-developing step, components dissolved from the photographic material and development-exhausted components accumulate considerably. Accordingly, substances produced during the development or produced due to the exhaustion with time become apt to be taken into the photographic material. The more lowered the replenishment rate of the succeeding washing step or the succeeding stabilizing step is, the more difficult it becomes to remove the above undesired substances. Similarly, in the case of the low-replenishment-rate of a bleach-fix bath, removal of the undesired substances becomes difficult.

Thus, when all the processing steps are carried out with the replenishment rate lowered, deterioration of the white background of the image, due to undesired substances remaining in the photographic material, becomes apparent. Especially, when a low-replenishment-rate running solution of a color developer is used, the occurrence of stain is a serious problem, and when the processing steps are carried out rapidly, stain on an image is liable to occur.

It is also found that, when inorganic substances, particularly such as colloidal silver and titanium oxide, are present densely, stain is liable to occur. The term "stain" used herein refers to coloring of a white background part, caused by coloring components in exhaustion accumulated components of a developing agent and the like, remaining in the processed photographic material.

SUMMARY OF THE INVENTION

As is apparent from the above description, an object of the present invention is to provide a method for processing a photographic material wherein the fluctuation of the processing due to rapid processing is low and an image high in sharpness is provided.

Another object of the present invention is to provide a method for processing a photographic material wherein stain, which will be caused when the photographic material is processed with the replenishment rate being low, is reduced and an image high in sharpness can be provided.

Other and further objects, features and advantages of the invention will appear more evident from the following description.

DETAILED DESCRIPTION OF THE INVENTION

Taking these problems into consideration, the inventor have keenly studied, first, means of lowering the processing fluctuation of photographic sensitivity in a high-temperature rapid processing as much as possible; and second, means of lowering stain (the amount of coloring components) in the photographic material processed by low-replenishment-rate processing; and the above objects have been attained by the following means.

(1) A method for processing a silver halide color photographic material having, on a support, at least one photosensitive silver halide emulsion layer, which comprises processing after exposure to light said silver halide color photographic material, wherein the silver halide in said emulsion layer contains 90 mol % or more of silver chloride, and said photographic material has a white pigment-containing hydrophilic colloid layer coated on the support, the coating amount of the white pigment being 2 g/m$^2$ or more, with a color developer containing chloride ions in an amount of 0.04 to 0.25 mol/l.

(2) A method for processing a silver halide color photographic material as stated under (1), wherein said photographic material is a photographic material further having a hydrophilic colloid layer containing colloidal silver and/or a hydrophilic colloid layer containing a particulate solid dye and/or a hydrophilic colloid layer containing a water-soluble dye.

(3) A method for processing a silver halide color photographic material as stated under (1), wherein the silver halide in said emulsion layer contains 90 mol % or more of silver chloride, and said photographic material has a white pigment-containing hydrophilic colloid layer coated on the support, the coating amount of the white pigment being 2 g/m$^2$ or more; the color-developing process comprises color-developing, desilvering, and washing or stabilizing; the replenishment rate for the color developer is 0.5 to 4 times the carried-over from the developing bath; the washing or the stabilizing step is conducted in a multi-stage countercurrent fashion; and the iron ions concentration of the final bath (e.g., the washing bath or the stabilizing bath) is 30 ppm or below.

(4) A method for processing a silver halide color photographic material as stated under (1), wherein the color-developing agent used in the color developer is a p-phenylenediamine derivative represented by the following formula (Dev):

formula (Dev):

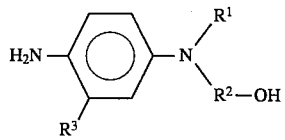

wherein $R^1$ and $R^3$ each represent an alkyl group having 1 to 4 carbon atoms, and $R^2$ represents a straight-chain or branched-chain alkylene having 3 to 4 carbon atoms.

(5) A method for processing a silver halide color photographic material as stated under (1), wherein the processing time from the start of the developing process to the end of the drying process is within 120 sec.

(6) A method for processing a silver halide color photographic material, which comprises methods as stated under (1) and (2).

(7) A method for processing a silver halide color photographic material as stated under (1), wherein the hydrophilic colloid layer of the photographic material contains a colorant capable of being decolored in the development processing.

The present invention is based on the finding that, when a photographic material having a hydrophilic colloid layer containing a white pigment on a support is used in order to improve sharpness, the fluctuation of photographic sensitivity, due to a change of temperature at the time of high-temperature rapid development, is unexpectedly made small by using 0.040 to 0.25 mol/liter of chloride ions in the developer.

That is, if the chloride ions concentration is less than 0.04 mol/liter, the fluctuation of the sensitivity, particularly of the lowermost layer (the layer near the white pigment layer) becomes large when the temperature of the developer varies, and if the chloride ions concentration exceeds 0.25 mol/liter, the same thing also happens. A particularly preferable range of the chloride ion concentration is 0.075 to 0.2 mol/l.

It has also be found that, if the above photographic material having a hydrophilic colloid layer containing a white pigment is developed with the replenishment rate being low; that is, if the running processing is carried out with the replenishment rate being 4 times or less the carried-over from the developing bath, stain is liable to occur; and that the stain is difficult to be washed out in the washing bath or the stabilizing bath into which the bleach-fix solution has been carried. Preferably the replenishment rate is 0.5 to 4 times, more preferably 1 to 2 times, the carried-over.

Particularly when the replenishment rate of the washing bath or the stabilizing bath was decreased, the amount of mixing of the bleach-fix solution increased, and stain increased when the mixed amount exceeded a certain level. Based on that finding, stain could have been decreased by controlling the iron ions concentration in the washing bath or the stabilizing bath to within the above range. Stain is decreased when the washing is carried out with the iron ions concentration of the final bath kept at preferably 30 ppm or less, more preferably 20 ppm or less, and particularly preferably 10 ppm or less. The iron ions concentration is preferably 0.5 ppm or more, more preferably 1 ppm or more. If the final bath comprises multiple baths, it is sufficient if at least one of the baths, preferably the final bath, has the above iron concentration.

Although described later specifically, for example, by providing preferably a three-stage or more stage counter-current bath, and/or by using a reverse osmotic membrane to purify the washing water, a washing process with a low-replenishment-rate could have been attained. As will be understood from this, it has been found that the processing time of the final bath of the multi-stage washing bath is longer than that of the other baths.

In the present invention, it has been found that the extent of the occurrence of stain and the fluctuation of photographic sensitivity, due to a change of the temperature in rapid processing, also vary depending on the type of the developing agent in a color developer. This is difficult to take place when a hydroxylalkyl-substituted p-phenylenediamine derivative having a specific structure as disclosed in JP-A No. 443/1992, which structure has rapid development processing ability, is used.

To improve sharpness of images, the effect of suppressing the scattering of light from a support is great, and the present invention has been based on, as a specific means therefor, a preferable technique for applying a white pigment on a support. It has also be found that the sharpness of images is remarkably improved by using a photographic material having a colloidal silver-containing layer and/or a particulate solid dye layer and/or a water-soluble dye on the layer to which the white pigment is applied.

That is, by carrying out the processing method of the present invention, described above associated with a photographic material having the above constitution, a processing method described above that will result in high sharpness, with low photographic fluctuation due to the processing, and with excellent processing stability has been attained. By low-replenishment rate processing with the waste solution being low, processing of a silver halide color photographic material that can give high sharpness has been attained.

The present invention will now be described in more detail.

In the color photographic material of the present invention, when the hydrophilic colloid layer containing a white pigment is provided on a support, it is required that the coating amount of the white pigment is 2 g/m$^2$ or more, preferably 4 g/m$^2$ or more, and more preferably 8 g/m$^2$ or more, though preferably it should not be more than 20 g/m$^2$ and more preferably it should not be more than 15 g/m$^2$. Although the content of the white pigment in the white pigment-containing hydrophilic colloid layer can be set arbitrarily within the range that satisfies the above conditions, the content is 10 wt. % or more, preferably 20 wt. % or more, more preferably 40 wt. % or more, and most preferably 70 wt. % or more, though preferably it should not be more than 98 wt. %.

The thickness of the white pigment-containing hydrophilic colloid layer will be determined from the above content and the above coating amount, and is preferably in the range of 0.5 to 10 μm.

The white pigment for use in the present invention includes, for example, titanium dioxide, barium sulfate, lithopone, alumina white, calcium carbonate, silica white, antimony trioxide, titanium phosphate, zinc oxide, white lead, and gypsum. Use of titanium oxide among these is particularly effective. The titanium oxide may be of the rutile structure or the anatase structure, and may be one manufactured by either the sulfate process or the chloride process.

With respect to the particle size of the white pigment to be used in hydrophilic colloid layer, use can be made of one having average size of 0.1 to 1.0 μm, preferably 0.2 to 0.3 μm.

In the present invention, as the binder constituting the hydrophilic colloid layer containing a white pigment, the photosensitive silver halide emulsion layers, the nonphotosensitive intermediate layer, and the like, gelatin is preferably used. If necessary, in place of the gelatin, some other hydrophilic colloid can be used in an arbitrary ratio.

Examples of the other hydrophilic colloid include, for example, gelatin derivatives; graft polymers of gelatin with other polymers; proteins, such as albumin and casein; cellulose derivatives (e.g., hydroxyethyl cellulose, carboxymethyl cellulose, and cellulose sulfate); saccharides, such as starch derivatives; sodium alginate; and a wide variety of synthetic polymers, such as polyvinyl alcohols, partially acetalized polyvinyl alcohols, poly(N-vinylpyrrolidone)s, polyacrylic acids, polymethacrylic acids, polyacrylamides, polyvinylimidazoles, or polyvinylpyrazoles.

In the present invention, to the white-pigment-containing hydrophilic colloid layer, may be added, in addition to the white pigment and the binder, various materials that will be added to photographic materials. Examples are surface-active agents as coating aids, hardeners, dyes, or antifoggants. Further, high-boiling organic solvents in the form of finely dispersed oil droplets may be added. When a dispersion of a high-boiling organic solvent is added, preferably various oil-soluble materials are contained by being dissolved therein. The photographic material according to the present invention comprises a support; at least three photosensitive emulsion layers applied thereon; a nonphotosensitive layer, such as a color-mixing-inhibiting layer and a protective layer; and a hydrophilic colloid layer containing a white pigment.

In the present invention, the hydrophilic colloid layer containing a white pigment is applied between the support and the photosensitive emulsion layer. The photosensitive emulsion layer may be provided directly on the hydrophilic colloid layer containing a white pigment, or may be provided through one or more nonphotosensitive hydrophilic colloid layer. When the nonphotosensitive hydrophilic colloid layer(s) is provided, the thickness of these layers is preferably 5 μm or less, more preferably 0.5 to 2 μm, in total.

These nonphotosensitive hydrophilic colloid layers may contain, if necessary, various photographically useful substances. Examples are a surface-active agent as a coating aid, a hardener, a dye, or an antifoggant.

Further, for example, colloidal silver, a dye dispersed in solid form, or a dye fixed to a cationic polymer may be added, to constitute a colored layer that can be decolored at the time of development processing. Said colored layer may be positioned in an arbitrary position, preferably on the white pigment layer, and more preferably between the white pigment-containing layer and the photosensitive emulsion layer.

A high-boiling organic solvent in the form of finely dispersed oil drops can be added. In the solvent, a photographically useful substance, such as an oil-soluble color-mix inhibitor, a fluorescent brightening agent, or an ultraviolet absorber may be added and dissolved.

In the photographic material for the present invention, a white pigment can be contained also in a water-resistant resin that covers the paper support in addition to the white pigment-containing hydrophilic colloid layer. In that case, preferably the white pigment is contained in the water-resistant resin on the side of the photosensitive emulsion.

In the present invention, as the coloring substances capable of being decolored by processing, the following can be mentioned.

Oxonol dyes described, for example, in U.S. Pat. Nos. 3,247,127, 3,469,985, and 4,078,933; anthraquinone dyes described, for example, in U.S. Pat. No. 2,865,752; or cyanine dyes described, for example, in U.S. Pat. Nos. 2,843,486 and 3,294,539; can be used as dyes for so-called halation or irradiation.

A technique can be used wherein a dye described, for example, in JP-A Nos. 309349/1990, 308244/1990, and 1133/1991, is dispersed in the form of a particulate solid. To disperse a dye in the form of a particulate solid, a technique is described in JP-A No. 308244/1990, pages 4 to 13, which, for example, uses a particulate dye that is substantially insoluble in water at a pH of 6 or below, but which is substantially soluble in water at a pH of 8 or over. Also, JP-A No. 239544/1989 discloses a technique that uses colloidal silver.

As the colloidal silver dispersion for use in the present invention, those that are generally used in color photographic materials for photographing can be used. The colloidal silver can be prepared in accordance with a method described, for example, in U.S. Pat. Nos. 2,688,601 or 3,459,563, or Belgian Patent No. 622,695. In the present invention, it is suggested that the colloidal silver is used after it is adjusted by desalting it enough to bring the electric conductance to 1800 $\mu Scm^{-1}$ or below. Preferably the amount of colloidal silver in the colloidal silver-containing layer is 0.01 to 0.5 g, particularly preferably 0.05 to 0.2 g, in terms of silver per square meter.

The colored layer that can be decolored by the processing to be used in the present invention may be arranged in contact with an emulsion layer directly, or through an intermediate layer containing a processing color-mix inhibitor, such as hydroquinone and gelatin. It is required that the colored layer is placed beneath an emulsion layer (on the support side)-that will be color-developed to the same primary color as that of the colored layer. It is possible that all or one or more of colored layers corresponding to primary colors may be arranged. It is also possible that a layer colored to correspond to several primary color regions mat be arranged. Preferably, the optical reflection density of the colored layer is such that the optical density value in the wavelength of the highest optical density in the visible radiation region having a wavelength of 400 nm to 700 nm is 0.2 or over but 3.0 or below, more preferably 0.5 nm or over but 2.5 nm or below, and particularly preferably 0.8 or more but 2.0 or below.

The term "reflective-type support" used herein refers to one that increases reflectivity to make sharp the dye image formed in a silver halide emulsion layer and such a reflective type support includes-one prepared by covering a support with a hydrophobic resin containing a light reflecting substance, such as titanium oxide, zinc oxide, calcium carbonate, and calcium sulfate, which is dispersed therein and a support made of a hydrophobic resin containing a dispersed light reflecting substance. Examples are polyethylene-covered paper, polypropylene synthetic paper, transparent supports, such as glass plates, polyester films made, for example, of polyethylene terephthalate, cellulose triacetate, or cellulose nitrate, polyamide films, polycarbonate films, polystyrene films, and vinyl chloride resins, which have a reflective layer or contain a reflective substance.

The reflective-type support used in the present invention is preferably a paper support both surfaces of which are covered with water-resistant resin layers at least one of which contains white pigment fine particles. Preferably, the white pigment particles are contained in an amount of 12 wt. % or more, more preferably 14 wt. % or more. It is suggested that the light reflecting white pigment particles are mixed well in the presence of a surface-active agent and preferably the surface of the white pigment is treated with a dihydric to tetrahydric alcohol.

Preferably the white pigment fine particles are uniformly dispersed in the reflective layer without forming clusters or the like, and the magnitude of its distribution can be found by measuring the occupied area ratio (%) (Ri) of the fine particles projected on a unit area. The deviation coefficient of the occupied area ratio (%) can be found by the ratio s/R of the standard deviation s of Ri to the average value (R) of Ri. In the present invention, preferably the deviation coefficient of the occupied area ratio (%) of the fine particles of the pigment is 0.15 or less, more preferably 0.12 or less, and particularly preferably 0.08 or less.

In the present invention, a support having a diffused reflective surface of the second kind is preferably used. The term "diffused reflection of the second kind" means diffused reflection obtained by making a mirror surface uneven so that the mirror surface may be divided into fine mirror surfaces directed in different directions, and the directions of the divided fine surfaces (mirror surfaces) may be dispersed. The unevenness of the surface of the second kind is such that the three-dimentional average roughness to the central plane is 0.1 to 2 μm, preferably 0.1 to 1.2 μm. The frequency of the ridges having a roughness of 0.1 μm or more have 0.1 to 2000 cycles/mm, more preferably 50 to 600 cycles/mm. Details of such a support are described in JP-A No. 239244/1990.

The color photographic material in the present invention can be formed by applying at least one yellow-color-forming silver halide emulsion layer, at least one magenta-color-forming silver halide emulsion layer, and at least one cyan-color-forming silver halide emulsion layer on a support having a reflective layer. In a common color photographic printing paper, by adding couplers capable of forming dyes having relationships complementary to lights to which the silver halide emulsions are sensitive, the color can be reproduced by the subtractive color process. A common color photographic printing paper can be formed in such a manner that silver halide emulsion grains are spectrally sensitized with a blue-sensitive spectral sensitizing dye, a green-sensitive spectral sensitizing dye, and a red-sensitive spectral sensitizing dye, in the order of the above color-forming layers, and they are applied on a support in the above-stated order. However, the order may be different. In view of the rapid processing, there is a case wherein a photosensitive layer containing silver halide grains having the greatest average grain size is preferably the uppermost layer; or in view of the preservability under exposure to light, there is a case wherein the lowermost layer is preferably a magenta color-forming photosensitive layer.

The photosensitive layers and the hues that will be formed by color forming may be formed not to have the above correspondence, and at least one infrared photosensitive silver halide emulsion layer can be used.

As the silver halide grains for use in the present invention, silver chloride, silver bromide, silver (iodo)chlorobromide, and silver iodobromide can be mentioned. Particularly, in the present invention, in order to shorten the development processing time, silver bromochloride grains or silver chloride grains substantially free from silver iodide can preferably be used. Herein the expression "substantially free from silver iodide" means that the silver iodide content is 1 mol % or less, preferably 0.2 mol % or less. On the other hand, for the purpose of increasing high-intensity sensitivity, spectral sensitization sensitivity, or long-term stability of the photographic material, there is a case wherein high-silver-chloride grains containing 0.01 to 3 mol % of silver iodide on the emulsion surface is preferably used as described in JP-A No. 84545/1991. Although the halogen composition of the emulsion may be different or uniform from grain to grain, when an emulsion having a halogen composition uniform from grain to grain is used, the properties of the grains can be easily made homogeneous. With respect to the halogen composition distribution in the silver halide emulsion grains, for example, grains having the so-called uniform-type structure, wherein the halogen composition is uniform throughout the grains; grains having the so-called layered-type structure, wherein the halogen composition of the core in the silver halide grains is different from that of the shell (consisting of a layer or layers) surrounding the core; or grains having a structure wherein non-layered parts different in halogen composition are present in the grains or on the surface of the grains (if the non-layered parts different in halogen composition are present on the surface of the grains, they may be joined to the edges, corners, or planes of grains) may suitably be chosen. To secure a high sensitivity, it is more advantageous to use one of the latter two than to use grains having a uniform-type structure and the latter two are also preferable in view of pressure-resistance properties. If the silver halide grains have the above structure, the boundary of parts different in halogen composition may be a clear boundary, an obscure boundary formed by a mixed crystal due to the difference of the composition, or a boundary wherein the structure is continuously changed positively.

For the photographic material suitable to a rapid processing, as in the present invention, a so-called high-silver-chloride emulsion is preferably used. In the present invention, the silver chloride content of the high-silver-chloride emulsion is preferably 90 mol % or more, more preferably 95 mol % or more.

In a such high-silver-chloride emulsion, preferably the silver bromide localized phase is layered or non-layered in the silver halide grains and/or on the surface of the grains as described above. The halogen composition of the above localized phase preferably has a silver bromide content of at least 10 mol %, more preferably the content is more than 20 mol %. The silver bromide content of the silver bromide localized layer can be analyzed, for example, by using the X-ray diffraction method (described, for example, in *Shinjikkenkagaku-koza* 6, *Kozokaiseki,* edited by Nihonkagakukai, published by Maruzen). The localized phase may be present in the grains or on the edges, corners, or planes of the grains and one preferable example is one wherein the localized phase is grown epitaxially on the corners of the grains.

For the purpose of decreasing the replenishment rate of the development processing solution, it is effective to increase further the silver chloride content of the silver halide emulsion. In that case, an emulsion comprising nearly pure silver chloride, for example an emulsion having a silver chloride content of 98 to 100 mol %, is also preferably used.

The average grain size of the silver halide grains contained in the silver halide emulsion used in the present invention (the average grain size is calculated in such a way that, by assuming the diameters of circles equivalent to the projected areas of the grains to be the grain sizes, its number average is designated as the average grain size) is preferably 0.1 to 2 μm.

The grain size distribution of them is preferably a monodisperse distribution wherein the deviation coefficient (which is obtained by dividing the standard deviation of the grain size distribution by the average grain size) is preferably 20% or less, desirably 15% or less, and more preferably 10% or less. At that time, for the purpose of obtaining a wide latitude, it is also preferably carried out that such monodisperse emulsions are blended to be used in one layer or are applied in layers.

With respect to the form of the silver halide grains contained in the photographic emulsion, a regular crystal form, such as a cubic form, a tetradecahedral form, or an octahedral form, an irregular crystal form, such as a sphere form or a tabular form, or a composite of these can be used. Also a mixture of various crystal forms can be used. In the present invention, it is desired that, out of these, the above regular crystal form amounts to 50% or more, preferably 70% or more, and more preferably 90% or more, in the grains.

Besides these, an emulsion wherein tabular grains having an average aspect ratio (the diameter/thickness in terms of circles) of 5 or more, preferably 8 or more, amount to over 50% in all the grains in terms of projected areas can be preferably used.

The silver chlorobromide emulsion for use in the present invention can be prepared by processes described, for example, by P. Glafkides in *Chimie et Phisique Photographigue* (published by Paul Montel, 1967), by G. F. Duffin in *Photographic Emulsion Chemistry* (published by Focal Press, 1966), and by V. L. Zelikman et al. in *Making and Coating Photographic Emulsion* (published by Focal Press, 1964). That is, any of the acid process, the neutral process, the ammonia process, and the like can be used and to react a soluble silver salt with a soluble halide, any of the single-jet method, the double-jet method, a combination of these, and the like can be used. A method wherein grains are formed in an atmosphere of excess silver ions (so-called reverse precipitation method) can also be used. As one type of the reverse precipitation method, a method wherein the pAg in the liquid phase wherein the silver halide will be formed is kept constant, that is, the so-called controlled double-jet method can be used. According to this method, a silver halide emulsion wherein the crystal form is regular and the grain size is nearly uniform can be obtained.

The localized phase of the silver halide grains of the present invention or its substrate preferably contains different metal ions or their complex ions. Preferable metal ions are selected from ions of metals belonging to Groups VIII and IIb of the Periodic Table, their complex ions, lead ions, and thallium ions. Mainly, in the localized phase, ions selected from iridium ions, rhodium ions, and iron ions, and their complex ions, can be used; and mainly, in the substrate, ions of metals selected from osmium, iridium, rhodium, platinum, ruthenium, palladium, cobalt, nickel, iron, etc., and their complex ions can be used in combination. The localized phase and the substrate may be different in their kind of the metal ions and the concentration of the metal ions. Several of these metals can be used. Particularly, it is preferable to allow an iron compound and an iridium compound to be present in the silver bromide localized phase.

These metal-ion-providing compounds are incorporated in the localized phase of the silver halide grains of the present invention and/or some other grain part (substrate) at the time of the formation of silver halide grains by means, for example, of adding them into an aqueous gelatin solution, an aqueous halide solution, an aqueous silver salt solution, or other aqueous solution serving as a dispersing medium, or by adding silver halide fine grains already containing the metal ions and dissolving the fine grains.

The metal ions to be used in the present invention may be incorporated in emulsion grains before, during, or immediately after the formation of the grains, which time will be selected depending on their position in the grains.

Generally the silver halide emulsion used in the present invention is chemically and spectrally sensitized.

As the chemical sensitization, that which uses a chalcogen sensitizer (specifically, sulfur sensitization, which typically includes the addition of an unstable sulfur compound; selenium sensitization, which uses a selenium compound; or tellurium sensitization, which uses a tellurium compound), noble metal sensitization, typically such as gold sensitization, and reduction sensitization can be used alone or in combination. With respect to compounds used in chemical sensitization, those described in JP-A No. 215272/1987, page 18 (the right lower column) to page 22 (the right upper column), are preferably used.

The emulsion used in the present invention is a so-called surface latent image-type emulsion, wherein a latent image is mainly formed on the grain surface.

To the silver halide emulsion used in the present invention, various compounds or their precursors can be added for the purpose of preventing fogging during the production process, storage, or the processing of the photographic material, or for the purpose of stabilizing the photographic performance. Specific examples of these compounds are described in the above-mentioned JP-A No. 215272/1987, pages 39 to 72, which compounds are preferably used. Further, 5-arylamino-1,2,3,4-thiatriazole compounds (whose aryl residues have at least one electron-attracting group respectively) described in EP 0447647 can also be preferably used.

The spectral sensitization is carried out for the purpose of spectrally sensitizing each emulsion layer of the present photosensitive material to a desired wavelength region of light.

In the photographic material of the present invention, as spectral sensitizing dyes used for spectral sensitization for blue, green, and red regions, for example, those described by F. M. Harmer in *Heterocyclic compounds-Cyanine dyes and related compounds* (published by John Wiley & Sons [New York, London], 1964) can be mentioned. As specific examples of the compounds and the spectral sensitization, those described in the above-mentioned JP-A No. 215272/1987, page 22 (the right upper column) to page 38, are preferably used. As the red-sensitive spectral sensitizing dyes for high-silver-chloride emulsion grains high in silver chloride content, spectral sensitizing dyes described in JP-A No. 123340/1991 are very preferable in view, for example, of the stability, the strength of the adsorption, and the temperature dependence of the exposure.

In the case wherein the photographic material of the present invention is to be spectral sensitized effectively in the infrared region, sensitizing dyes described in JP-A No. 15049/1991, page 12 (the left upper column) to page 21 (the left lower column); in JP-A No. 20730/1991, page 4 (the left lower column) to page 15 (the left lower column); in EP-0,420,011, page 4, line 21, to page 6, line 54; in EP-0,420,012, page 4, line 12, to page 10, line 33; in EP-0,443,466; and in U.S. Pat. No. 4,975,362 are preferably used.

To incorporate these spectral sensitizing dyes into the silver halide emulsion, they may be directly dispersed into the emulsion, or after they are dissolved in a solvent or a combination of solvents, such as water, methanol, ethanol, propanol, methyl Cellosolve, and 2,2,3,3-tetrafluoropropanol, the solution may be added to the emulsion. Also the spectral sensitizing dye may be formed together with an acid or a base into an aqueous solution, as described in JP-B ("JP-B" means examined Japanese patent publication) Nos. 23389/1969, 27555/1969, and 22089/1982, or the spectral sensitizing dye may be formed together with a surface-active agent into an aqueous solution or a colloid dispersion, as described in U.S. Pat. Nos. 3,822,135 and 4,006,025, and the obtained aqueous solution or colloid dispersion may be added to the emulsion. Also after the spectral sensitizing dye may be dissolved in a solvent substantially immiscible with water, such as phenoxyethanol, the solution is dispersed in water or a hydrophilic colloid and is added to the emulsion. The spectral sensitizing dye may be directly dispersed in a hydrophilic colloid, as described in JP-A Nos. 102733/1978 and 105141/1983, and the dispersion is added to the emulsion. The time at which the dispersion or solution is added to the emulsion may be at any stage of the preparation of the emulsion, which time is hitherto known and considered useful. That is, the dispersion or the solution may be added before or during the formation of grains of the silver halide emulsion, or during the period from immediately after the formation of grains till the washing step, or before or during the chemical sensitization, or during the period from immediately after the chemical sensitization till the cooling and solidifying of the emulsion, or at the time the coating solution is prepared. Although generally the addition of the dispersion or the solution is carried out in a period after the completion of the chemical sensitization and before the application, the dispersion or the solution may be added together with a chemical sensitizer to carry out spectral sensitization and chemical sensitization at the same time, as described in U.S. Pat. Nos. 3,628,969 and 4,225,666; or the addition may be carried out before chemical sensitization, as described in JP-A No. 113928/1983; or the dispersion or the solution may be added before the completion of the precipitation of the silver halide grains, to allow the spectral sensitization to start. Further, as taught in U.S. Pat. No. 4,225,666, it is possible that the spectrally sensitizing dye may be divided into two portions and added: one portion is added prior to chemical sensitization, and the other is added after the chemical sensitization. As shown in U.S. Pat. No. 4,183,756, the dispersion or the solution may be added at any time during the formation of silver halide grains. In particular, the sensitizing dye is preferably added before the washing step of the emulsion or before chemical sensitization of the emulsion.

The amount of these spectral sensitizing dyes to be added varies widely depending on the case and is preferably in the range of $0.5\times10^{-6}$ to $1.0\times10^{-2}$ mol, more preferably $1.0\times10^{-6}$ to $5.0\times10^{-3}$ mol, per mol of the silver halide.

In the present invention, if a sensitizing dye has spectral sensitization sensitivity particularly in from the red region to the infrared region, it is preferable to use additionally a compound described in JP-A No. 157749/1990, page 13 (the right upper column) to page 22 (the right lower column). By using these compounds, the preservability of the photographic material, the stability of the processing, and the supersensitizing effect can be increased specifically. In particular, additional use of compounds of general formulae (IV), (V), and (VI) in that patent is particularly preferable. These compounds are used in an amount of $0.5\times10^{-5}$ mol to $5.0\times10^{-2}$ mol, preferably $5.0\times10^{-5}$ mol to $5.0\times10^{-3}$ mol, per mol of the silver halide and the advantageous amount is in the range of 0.1 to 10,000, preferably 0.5 to 5,000, times one mol of the sensitizing dye.

As a binder or protective colloid that can be used in the photographic material according to the present invention, gelatin is advantageously used, but some other hydrophilic colloid can be used alone or in combination with gelatin. As a gelatin, preferably low-calcium gelatin having a calcium content of 800 ppm or less, more preferably 200 ppm or less, is used. In order to prevent various fungi or bacteria from propagating in the hydrophilic colloidal layer to deteriorate the image quality, preferably a mildew-proofing agent, as described in JP-A No. 271247/1988, is added.

As a support to be used for the photographic material according to the present invention, a white polyester support for display may be used, or a support wherein a layer containing white pigment is provided on the side that will have a silver halide layer. Further, in order to improve sharpness, preferably an anti-halation layer is applied on the side of the support where the silver halide emulsion layer is applied or the undersurface of the support. In particular, preferably the transmission density of the support is set in the range of 0.35 to 0.8, so that the display can be appreciated through either reflected light or transmitted light.

Further, a transparent support is preferably used as a support to be used in the present invention. In this case, preferably an anti-halation layer is applied on the side of the support where the silver halide emulsion layer is applied or the undersurface of the support.

The photographic material according to the present invention may be exposed to visible light or infrared light. The method of exposure may be low-intensity exposure or high-intensity short-time exposure, and particularly in the later case, the laser scan exposure system, wherein the exposure time per picture element is less than $10^{-4}$ sec is preferable.

When exposure is carried out, the band stop filter, described in U.S. Pat. No. 4,880,726, is preferably used. Thereby light color-mixing is eliminated and the color reproduction is remarkably improved.

As the silver halide emulsion to be applied to the photographic material of the present invention and the other materials (e.g., additives) and the photographic constitutional layers (including the arrangement of the layers) to be applied thereto and the processing method and additives used in the processing of the photographic material of the present invention, those described in the below-mentioned patent gazettes, particularly in European Patent EP 0,355,660A2 (JP-A No. 139544/1990), are preferably used.

| Element constituting photographic material | JP-A No. 215272/1987 | JP-A No. 33144/1990 | EP 0,355,660A2 |
|---|---|---|---|
| Silver halide emulsion | p. 10 upper right column line 6 to p. 12 lower left column line 5, and p. 12 lower right column line 4 from the bottom to p. 13 upper left column line 17 | p. 28 upper right column line 16 to p. 29 lower right column line 11 and p. 30 lines 2 to 5 | p. 45 line 53 to p. 47 line 3 and p. 47 lines 20 to 22 |
| Solvent for silver halide | p. 12 lower left column line 6 to 14 and p. 13 upper left column line 3 from the bottom to p. 18 lower left column last line | — | — |
| Chemical sensitizing agent | p. 12 lower left column line 3 from the bottom to lower right column line 5 from the bottom and p. 18 lower right column line 1 to p. 22 upper right column line 9 from the bottom | p. 29 lower right column line 12 to last line | p. 47 lines 4 to 9 |
| Spectral sensitizing agent (method) | p. 22 upper right column line 8 from the bottom to p. 38 last line | p. 30 upper left column lines 1 to 13 | p. 47 lines 10 to 15 |
| Emulsion stabilizer | p. 39 upper left column line 1 to p. 72 upper right column last line | p. 30 upper left column line 14 to upper right column line 1 | p. 47 lines 16 to 19 |
| Developing accelerator | p. 72 lower left column line 1 to p. 91 upper right column line 3 | — | — |
| Color coupler (Cyan, Magenta, and Yellow coupler) | p. 91 upper right column line 4 to p. 121 upper left column line 6 | p. 3 upper right column line 14 to p. 18 upper left column last line and p. 30 upper right column line 6 to p. 35 lower right column line 11 | p. 4 lines 15 to 27, p. 5 line 30 to p. 28 last line, p. 45 lines 29 to 31 and p. 47 line 23 to |

-continued

| Element constituting photographic material | JP-A No. 215272/1987 | JP-A No. 33144/1990 | EP 0,355,660A2 |
|---|---|---|---|
| | | | p. 63 line 50 |
| Color Formation-strengthen agent | p. 121 upper left column line 7 to p. 125 upper right column line 1 | — | — |
| Ultraviolet absorbing agent | p. 125 upper right column line 2 to p. 127 lower left column last line | p. 37 lower right column line 14 to p. 38 upper left column line 11 | p. 65 lines 22 to 31 |
| Discoloration inhibitor (Image-dye stabilizer) | p. 127 lower right column line 1 to p. 137 lower left column line 8 | p. 36 upper right column line 12 to p. 37 upper left column line 19 | p. 4 line 30 to p. 5 line 23, p. 29 line 1 to p. 45 line 25 p. 45 lines 33 to 40 and p. 65 lines 2 to 21 |
| High-boiling and/or low-boiling solvent | p. 137 lower left column line 9 to p. 144 upper right column last line | p. 35 lower right column line 14 to p. 36 upper left column line 4 | p. 64 lines 1 to 51 |
| Method for dispersing additives for photograph | p. 144 lower left column line 1 to p. 146 upper right column line 7 | p. 27 lower right column line 10 to p. 28 upper left column last line and p. 35 lower right column line 12 to p. 36 upper right column line 7 | p. 63 line 51 to p. 64 line 56 |
| Film Hardener | p. 146 upper right column line 8 to p. 155 lower left column line 4 | — | — |
| Developing Agent precursor | p. 155 lower left column line 5 to p. 155 lower right column line 2 | — | — |
| Compound releasing development inhibitor | p. 155 lower right column lines 3 to 9 | — | — |
| Support | p. 155 lower right column line 19 to p. 156 upper left column line 14 | p. 38 upper right column line 18 to p. 39 upper left column line 3 | p. 66 line 29 to p. 67 line 13 |
| Constitution of photosensitive layer | p. 156 upper left column line 15 to p. 156 lower right column line 14 | p. 28 upper right column lines 1 to 15 | p. 45 lines 41 to 52 |
| Dye | p. 156 lower right column line 15 to p. 184 lower right column last line | p. 38 upper left column line 12 to upper right column line 7 | p. 66 lines 18 to 22 |
| Color-mix inhibitor | p. 185 upper left column line 1 to p. 188 lower right column line 3 | p. 36 upper right column lines 8 to 11 | p. 64 line 57 to p. 65 line 1 |
| Gradation controller | p. 188 lower right column lines 4 to 8 | — | — |
| Stain inhibitor | p. 188 lower right column line 9 to p. 193 lower right column line 10 | p. 37 upper left column last line to lower right column line 13 | p. 65 line 32 to p. 66 line 17 |
| Surface-active agent | p. 201 lower left column line 1 to p. 210 upper right column last line | p. 18 upper right column line 1 to p. 24 lower right column last line and p. 27 lower left column line 10 from the bottom to lower right column line 9 | — |
| Fluorine-containing agent (As Antistatic agent, coating aid, lubricant, adhesion inhibitor, or the like) | p. 210 lower left column line 1 to p. 222 lower left column line 5 | p. 25 upper left column line 1 to p. 27 lower right column line 9 | — |
| Binder (Hydrophilic colloid) | p. 222 lower left column line 6 to p. 225 upper left column last line | p. 38 upper right column lines 8 to 18 | p. 66 lines 23 to 28 |
| Thickening agent | p. 225 upper right column line 1 to p. 227 upper right column line 2 | — | — |
| Antistatic agent | p. 227 upper right column line 3 to p. 230 upper left column line 1 | — | — |
| Polymer latex | p. 230 upper left column line 2 to p. 239 last line | — | — |
| Matting agent | p. 240 upper left column line | — | — |

-continued

| Element constituting photographic material | JP-A No. 215272/1987 | JP-A No. 33144/1990 | EP 0,355,660A2 |
|---|---|---|---|
| | 1 to p. 240 upper right column last line | | |
| Photographic processing method (processing process, additive, etc.) | p. 3 upper right column line 7 to p. 10 upper right column line 5 | p. 39 upper left column line 4 to p. 42 upper left column last line | p. 67 line 14 to p. 69 line 28 |

Note: In the cited part of JP-A No. 215272/1987, amendment filed on March 16, 1987 is included. Further, among the above-mentioned couplers, it is preferred to use so called short wavelength-type yellow coupler, described in JP-A Nos. 231451/1988, 123047/1988, 241547/1988, 173499/1989, 213648/1989, and 250944/1989, as a yellow coupler.

Preferably, the cyan, magenta, and yellow couplers are impregnated into loadable latex polymers (e.g., loadable latex polymers described in U.S. Pat. No. 4,203,716) in the presence or absence of a high-boiling organic solvent listed in the above table, or they are dissolved together with water-insoluble and organic solvent-soluble polymers and are emulsified and dispersed into hydrophilic colloid aqueous solution.

As water-insoluble and organic solvent-soluble polymers that can be preferably used, homopolymers or copolymers described in U.S. Pat. No. 4,857,449, the seventh column to the fifteenth column, and in International Publication No. WO 88/00723, pages 12 to 30, can be mentioned. More preferably, methacrylate-type polymers or acrylamide-type polymers, particularly acrylamide-type polymers, are used in view of color image stability and the like.

In the photographic material according to the present invention, color image preservability improving compounds as described in European Patent EP 0277589A2 are preferably used together with couplers, particularly, together with pyrazoloazole couplers and pyrrolotriazole couplers.

That is, the use of a compound (F) described in the above-mentioned patent specifications that combines with the aromatic amine developing agent remaining after the color development processing to form a chemically inactive and substantially colorless compound and/or a compound (G) described in the above-mentioned patent specifications that combines with the oxidized product of the aromatic amine color developing agent remaining after the color development processing to form a chemically inactive and substantially colorless compound simultaneously or singly is preferable. This is because, for example, the occurrence of stain or other side effects due to the formation of color formed dyes by the reaction of the color developing agent or its oxidized product remaining in the film during the storage after the processing with couplers can be prevented.

Further, as the cyan couplers, in addition to diphenylimidazole cyan couplers described in JP-A No. 33144/1990, 3-hydroxypyridine cyan couplers described in European Patent EP 0333185A2 (particularly, that formed by attaching a chlorine coupling-off group to the 4-equivalent coupler of Coupler (42) to make it to be 2-equivalent and Couplers (6) and (9) which are listed as specific examples are preferable), cyclic active methylene cyan couplers described in JP-A No. 32260/1989 (particularly Coupler Examples 3, 8, and 34 that are listed as specific examples are preferable), pyrrolopyrazole cyan couplers described in European Patent EP 0456226A1, pyrroloimidazole cyan couplers described in European Patent EP 0484909, and pyrrolotirazole cyan couplers described in European Patents EP 0488248 and EP 491197A1 are preferably used. Among them, pyrrolotriazole cyan couplers are particularly preferably used.

As the yellow couplers, in addition to the compounds listed in the above table, acylacetamide yellow couplers whose acyl group has a 3- to 5-membered cyclic structure described in European Patent EP 0447969A1, malondianilide yellow coupler having a cyclic structure described in European Patent EP 0482552A1, and acylacetamide yellow couplers having a dioxane structure described in U.S. Pat. No. 5,118,599 are preferably used. Among them, acylacetamide yellow couplers whose acyl group is a 1-alkylcyclopropane-1-carbonyl group and malondianilide yellow couplers wherein one of the anilide constitutes an indoline ring are preferably used. These couplers can be used alone or in combination.

As the magenta couplers used in the present invention, 5-pyrazolone magenta couplers and pyrazoloazole magenta couplers as described in the known literature shown in the above table are used, but in particular, in view, for example, of the hue, the stability of images, and the color forming properties, pyrazolotriazole couplers wherein a secondary or tertiary alkyl group is bonded directly to the 2-, 3-, or 6-position of the pyrazolotriazole ring as described in JP-A No. 65245/1986, pyrazoloazole couplers containing a sulfonamido group in the molecule as described in JP-A No. 65246/1986, pyrazoloazole couplers having an alkoxyphenylsulfonamido ballasting group as described in JP-A No. 147254/1986, and pyrazoloazole couplers having an alkoxy group or an aryloxy group in the 6-position as described in European Patent Nos. 226,849A and 294,785A are preferably used.

As the processing method of color photographic material of the present invention, besides methods described in the above-described table, processing materials and processing method described in JP-A No. 207250/1990, p. 26 (right lower column line 1) to p. 34 (right upper column line 9) and in JP-A No. 97355/1992, p. 5 (left upper column line 17) to p. 18 (right lower column line 20) are preferable.

Color materials and processing methods for use in the present invention will be described in detail. In the present invention, the photographic material is subjected to a color developing, desilvering, and water-washing or stabilizing process. The color developer to be used in the present invention contains known aromatic primary amine color-developing agent. Preferred examples are p-phenylene-diamine derivatives, and as representative examples thereof can be mentioned N,N-diethyl-p-phenylenediamine, 4-amino-N,N-diethyl-3-methylaniline, 4-amino-N-(β-hydroxyethyl)-N-methylaniline, 4-amino-N-ethyl-N-(β-hydroxyethyl)aniline, 4-amino-N-ethyl-N-(β-hydroxyethyl)-3-methylaniline, 4-amino-N-ethyl-N-(3-hydroxypropyl)-3-methylaniline, 4-amino-N-ethyl-N-( 4-hydroxybutyl)-3-methylaniline, 4-amino-N-ethyl-N-(β-methanesulfonamidoethyl)-3-methylaniline, 4-amino-N-ethyl-N-ethyl-3-(β-hydroxyethyl)aniline, 4-amino-N-ethyl-N-(β-methoxyethyl)-3-methylaniline, 4-amino-N-(β-ethoxyethyl)-N-ethyl-3-methylaniline, 4-amino-N-(3-carbamoylpropyl)-N-n-propyl-3-methylaniline, 4-amino-N-(3-carbamoylbutyl)-N-n-propyl-3-methylaniline, N-(4-amino-3-methylphenyl)-3-hydroxypyrrolidine, N-(4-amino-3-methylphenyl)-3-(hydroxymethyl)pyrrolidine, and N-(4-amino-3-methylphenyl)-3-pyrrolidinecarboxyamide.

Among the above-described p-phenylenediamine derivatives, 4-amino-N-ethyl-N-(β-methanesulfonamidoethyl)-3-methylaniline, 4-amino-N-ethyl-N-(3-hydroxypropyl)-3-methylaniline, and 4-amino-N-ethyl-N-(4-hydroxybutyl)-3-methylaniline are preferable.

Preferable p-phenylenediamine derivative to be used in the present invention is represented by the following formula (Dev):

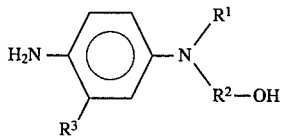

formula (Dev)

wherein $R^1$ and $R^3$ each represent an alkyl group having 1 to 4 carbon atoms, and $R^2$ represents a straight-chain alkylene group having 3 to 4 carbon atoms. Specific examples of the alkyl group shown by $R^1$ and $R^3$ include methyl, ethyl, propyl, isopropyl, butyl, and sec-butyl. Also, specific examples of the alkylene group shown by $R^2$ include propylene, butylene, 1-methylethylene, 2-methylethylene, 1-methylpropylene, 2-methylpropylene and 3-methylpropylene.

In formula (Dev), $R^1$ represents preferably ethyl or propyl; $R^3$ represents preferably methyl or ethyl; and $R^3$ represents preferably propylene or butylene as a straight chain, and most preferably butylene.

Examples of preferable compound are shown below, but the invention is not limited to them.

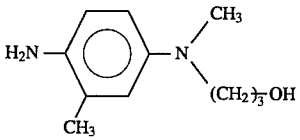

(I-1)

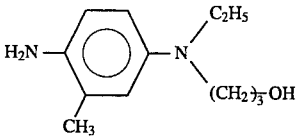

(I-2)

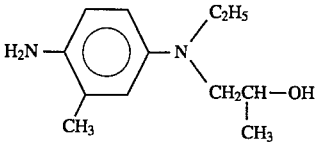

(I-3)

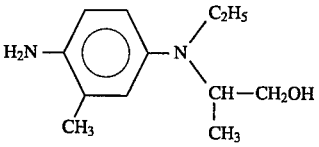

(I-4)

-continued

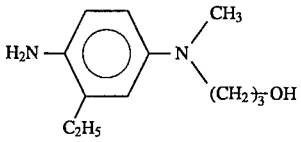

(I-5)

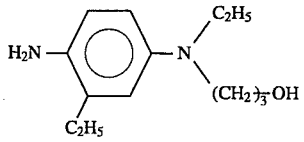

(I-6)

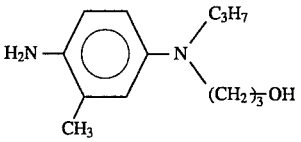

(I-7)

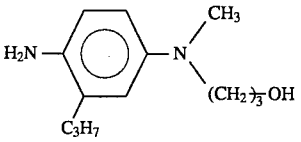

(I-8)

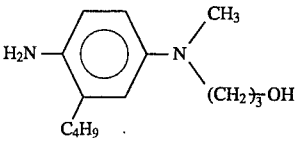

(I-9)

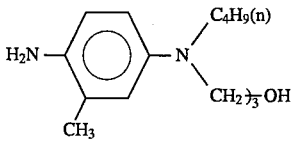

(I-10)

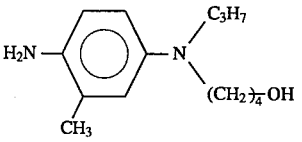

(I-11)

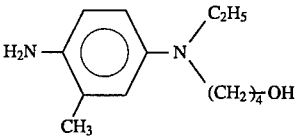

(I-12)

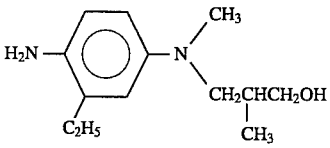

(I-13)

These p-phenylenediamine derivatives may be in the form of salts such as sulfates, hydrochloride, sulfites, and p-toluenesulfonates. The amount of said aromatic primary amine developing agent to be used is preferably about 0.002 to 0.2 mol, more preferably 0.005 to 0.1 mol, per liter of color developer.

When a replenishing parts of developing agent of the color developer is stored at a low pH, such as pH 2 to 6, the salt of sulfinic acid shown below is preferably used. The amount of sulfinate contained in the low-pH replenishing solution may be 0.001 to 0.1 mol, preferably 0.002 to 0.2 mol, per liter of replenishing solution.

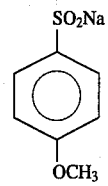

(S-1)

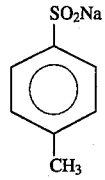

(S-2)

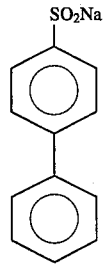

(S-3)

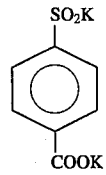

(S-4)

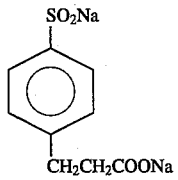

(S-5)

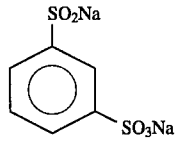

(S-6)

In practicing the present invention, remarkable effects can be attained in the case of using a color developer substantially free from benzyl alcohol. Herein the term "substantially free from" means that the concentration of benzyl alcohol is preferably 2.0 ml/l or below, more preferably 0.5 ml/l or below, and most preferably benzyl alcohol is not contained at all.

It is more preferable that the color developer for use in this invention is substantially free from sulfite ions (herein "substantially free from" means that the concentration of sulfite ions is $3.0\times10^{-3}$ mol/l or below), in order to suppress the variation of photographic properties due to the continuous processing and to attain the effects of the invention more remarkably. More preferably the concentration of sulfite ions is $1.0\times10^{-3}$ mol/l or below, and most preferably sulfite ion is not contained at all. However, in the present invention, a little amount of sulfite ions contained in a processing agents kit wherein the developing agent has been concentrated before preparing solution to be used, in order to prevent the oxidation of agents, is excluded.

Preferably, the color developer to be used in the present invention is substantially free from sulfite ions, and more preferably, in addition thereto it is substantially free from hydroxylamine (herein "substantially free from hydroxylamine" means that preferably the concentration of hydroxylamine is $5.0\times10^{-3}$ mol/l or below), in order to suppress the variation of photographic properties due to the changing of concentration of hydroxylamine. Most preferably hydroxylamine is not contained at all.

It is more preferable that the color developer to be used in the present invention contains an organic preservative instead of above-described hydroxylamine or sulfite ions.

Herein the term "organic preservative" refers to organic compounds that generally, when added to the processing solution for the color photographic material, reduce the speed of deterioration of the aromatic primary amine color-developing agent. That is, organic preservatives include organic compounds having a function to prevent the color developing agent from being oxidized, for example, with air, and in particular, hydroxylamine derivatives (excluding hydroxylamine, hereinafter the same being applied), hydroxamic acids, hydrazines, hydrazides, phenols, α-hydroxyketones, α-aminoketones, saccharides, monoamines, diamines, polyamines, quaternary ammonium salts, nitroxy radicals, alcohols, oximes, diamide compounds, and condensed cyclic amines are effective organic preservatives. These are disclosed, for example, JP-B No. 30496/1973, JP-A Nos. 143020/1977, 4235/1988, 30.845/1988, 21647/1988, 44655/1988, 53551/1988, 43140/1988, 56654/1988, 58346/1988, 43138/1988, 146041/1988, 44657/1988, and 44656/1988, U.S. Pat. Nos. 3,615,503 and 2,494,903, and JP-A Nos. 97953/1989, 186939/1989, 186940/1989, 187557/1989, and 306422/1990. As the other preservative, various metals described in JP-A Nos. 44148/1982 and 53749/1982, salicylic acids described in JP-A No. 180588/1984, amines described in JP-A Nos. 239447/1988, 128340/1988, 186939/1989, and 187557/1989, alkanolamines described in JP-A No. 3532/1979, polyethyleneimines described in JP-A No. 94349/1981, aromatic polyhydroxyl compounds described in U.S. Pat. No. 3,746,544 maybe included, if needed. It is particularly preferable the addition of alkanolamines, such as triethanolamine, dialkylhydroxylamines, such as N,N-diethylhydroxylamine and N,N-di(sulfoethyl)hydroxylamine, hydrazine derivatives (excluding hydrazine), such as N,N-bis(carboxymethyl)-hydrazine, or aromatic polyhydroxyl compounds, such as sodium catechol-3,5-disulfonate.

In particular, the use of alkanolamines in combination with dialkylhydroxylamine and/or hydrazine derivatives is more preferable in view of stability improvement of the color developer resulting its stability improvement during the continuous processing.

In the present invention, the color developer preferably contains bromide ions in an amount of $3\times10^{-5}$ to $1\times10^{-3}$ mol/l, more preferably $5.0\times10^{-5}$ to $5\times10^{-4}$ mol/l. When the concentration of bromide ions exceeds $1\times10^{-3}$ mol/l, developing is retarded, resulting maximum density and sensitivity being lowered, and when the concentration is less than $3.0\times10^{-5}$ mol/l, fogging cannot be prevented sufficiently.

Herein, chloride ions and bromide ions may be added directly to the color developer, or they may be allowed to dissolve out from the photographic material in the color developer at the development processing.

If chloride ions are added directly to the color developer, as the chloride ion-supplying material can be mentioned sodium chloride, potassium chloride, ammonium chloride, lithium chloride, magnesium chloride, and calcium chloride. Further, they may be supplied from a fluorescent brightening agent that is added to the color developer.

As the bromide ion-supplying material can be mentioned sodium bromide, potassium bromide, ammonium bromide, lithium bromide, calcium bromide, and magnesium bromide.

When chloride ions and bromide ions are allowed to dissolve out from the photographic material in the color developer, both the chloride ions and bromide ions may be supplied from the emulsion or a source other than the emulsion.

Preferably the pH of the color developer to be used in the present invention is in the range of 9 to 12, more preferably 9 to 11.0, and other known compounds that are components of a conventional developing solution can be contained in the color developing solution.

In order to keep the above pH, it is preferable to use various buffers. As buffers, use can be made, for example, carbonates, phosphates, borates, tetraborates, hydroxylbenzoates, glycyl salts, N,N-dimathylglycinates, leucinates, norleucinates, guanine salts, 3,4-dihydroxyphenylalanine salts, alanine salts, aminobutyrates, 2-amino-2-methyl-1,3-propandiol salts, valine salts, proline salts, trishydroxyaminomethane salts, and lysine salts. It is particularly preferable to use carbonates, phosphates, tetraborates, and hydroxybenzoates as buffers, because they have advantages that they are excellent in solubility and in buffering function in the high pH range of a pH 9.0 or higher, they do not adversely affect the photographic function (for example, to cause fogging), and they are inexpensive.

As specified examples of buffer, there are included sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate), and potassium 5-sulfo-2-hydroxybenzoate (potassium 5-sulfosalicylate). However, the present invention is not limited to these compounds.

The amount of buffer to be added to the color developer is preferably 0.1 mol/l or more, and particularly preferably 0.1 to 0.4 mol/l.

In addition to the color developer can be added various chelating agents to prevent calcium or magnesium from precipitating or to improve the stability of the color developer. Specific examples are shown below: nitrilotriacetic acid, diethylenetriaminepentaacetic acid, ethylenediaminetetraacetic acid, N,N,N-trimethylenephosphonic acid, ethylenediamine-N,N,N',N'-tetramethylenephosphonic acid, transcyclohexanediaminetetraacetic acid, 1,2-diaminopropanetetraacetic acid, glycol ether diaminetetraacetic acid, ethylenediamineorthohydroxyphenylacetic acid, 2-phosphonobutane-2,4-tricarboxylic acid, 1-hydroxyethylidene-1,1-diphosphonic acid, N,N'-bis(2-hydroxybenzyl)ethylenediamine-N,N'-diacetic acid, hydroxyethyliminodiacetic acid. If necessary, two or more of these chelating agents may be used together.

With respect to the amount of these chelating agents to be added, it is good if the amount is enough to sequester metal ions in the color developer. The amount, for example, is on the order of 0.1 g to 10 g per liter.

If necessary, any development accelerator can be added to the color developer.

As development accelerators, the following can be added as desired: thioether compounds disclosed, for example, in JP-B Nos. 16088/1962, 5987/1962, 7826/1963, 12380/1969, and 9019/1970, and U.S. Pat. No. 3,813,247; p-phenylenediamine compounds disclosed in JP-A Nos. 49829/1977 and 15554/1975; quaternary ammonium salts disclosed, for example, in JP-A No. 137726/1975, JP-B No. 30074/1969, and JP-A Nos. 156826/1981 and 43429/1977; amine compounds disclosed, for example, in U.S. Pat. Nos. 2,494,903, 3,128,182, 4,230,796, and 3,253,919, JP-B No. 11431/1966, and U.S. Pat. Nos. 2,482,546, 2,596,926, and 3,582,346; polyalkylene oxides disclosed, for example, in JP-B Nos. 16088/1962 and 25201/1967, U.S. Pat. No. 3,128,183, JP-B Nos. 11431/1966 and 23883/1967, and U.S. Pat. No. 3,532,501; 1-phenyl-3-pyrazolidones, and imidazoles.

In the present invention, if necessary, any antifoggant can be added. As antifoggants, use can be made of alkali metal halides, such as sodium chloride, potassium bromide, and potassium iodide, and organic antifoggants. As typical organic antifoggants can be mentioned, for example, nitrogen-containing heterocyclic compounds, such as benzotriazole, 6-nitrobenzimidazole, 5-nitroisoindazole, 5-methylbenzotriazole, 5-nitrobenzotriazole, 5-chloro-benzotriazole, 2-thiazolylbenzimidazole, 2-thiazolylmethyl-benzimidazole, indazole, hydroxyazaindolizine, and adenine.

It is preferable that the color developer that is adaptable in the present invention contains a fluorescent brightening agent. As the fluorescent brightening agent, 4,4'-diamino-2,2'-disulfostilbene compounds are preferable, which will be added in an amount of 0 to 5 g/l, preferably 0.1 to 4 g/l.

If required, various surface-active agents, such as alkylsulfonic acids, arylsulfonic acids, aliphatic carboxylic acids, aromatic carboxylic acids, and polyalkyleneimines may be added.

With respect to the color developer of the present invention, for details other than the above described those of a usual color developer can be adapted.

The processing temperature of the color developer adaptable to the present invention is 20° to 50° C., preferably 30° to 45° C., and most preferably 37° to 42° C. The processing time is 5 sec to 2 min, and preferably 10 sec to 1 min. Although it is preferable that the replenishing amount is as small as possible, it is suitable that the replenishing amount is 20 to 600 ml, preferably 30 to 200 ml, more preferably 40 to 100 ml, per $m^2$ of the photographic material.

The photographic material is generally subjected to a desilvering process after color development. The desilvering process can be carried out by a bleaching process and a fixing process, separately, or carried out at the same time (bleach-fixing process). Further, to quicken the process bleach-fixing may be carried out after the bleaching process. In accordance with the purpose, the process may be arbitrarily carried out using a bleach-fixing bath having two successive tanks, or a fixing process may be carried out before the bleach-fixing process, or a bleaching process may be carried out after the bleach-fixing process.

As the bleaching agent to be used in a bleaching solution and a bleach-fixing solution, use can be made of, for example, iron salts, compounds of polyvalent metals, such as iron (III), cobalt (III), chromium (VI), and copper (II), peracids, quinones, and nitro compounds. As typical bleaching agents, use can be made of iron chlorides, ferricyanides, dichromates, organic complex salts of iron (III) (e.g., complex salts of aminopolycarboxylic acid, such as ethylenediaminetetraacetic acid, diethylenetriaminepentaacetic acid, cyclohexanediaminetetraacetic acid, methyliminodiacetic acid, 1,3-diaminopropanetetraacetic acid, and glycoletherdiaminetetraacetic acid), persulfates, bromates, permanganates, and nitrobenzenes. Of these, aminopolycarboxylic acid complex salts of iron (III), including ethylenediaminetetraacetic acid iron (III) complex salts and 1,3-diaminopropanetetraacetic acid iron (III) complex salts are preferable in view of the rapid processing and the prevention of environmental pollution. Further, aminopolycarboxylic acid iron (III) complex salts are particularly useful in a bleaching solution as well as a bleach-fix solution. The bleaching solution or the bleach-fix solution using these aminopolycarboxylic acid iron (III) complex salts is generally used in pH 3 to 8.

Known additives, for example, a rehalogenating agent such as ammonium bromide and ammonium chloride, a pH buffer such as ammonium nitrare, and a metal-corrosion-preventing agent such as ammonium sulfate can be added in the bleaching solution or the bleach-fix solution.

In addition to the above-described compounds, an organic acid is preferably contained in the bleaching solution and the bleach-fix solution. Particularly preferable organic acids include compounds having an acid dissociation constant (pKa) of 2 to 5.5, and specifically acetic acid and propionic acid are preferable.

Although as the fixing agents to be used in the fixing solution and bleach-fix solution use can be made of thiosulfates, thiocyanates, thioether compounds, thioureas, and a large amount of iodide salts, the use of thiosulfate is general, particularly ammonium thiosulfate can be used most widely. Further, combination use of thiosulfate with thiocyanate, thioether compound, or thiourea is also preferable.

As a preservative for the fixing solution and the bleach-fixing solution, sulfites, bisulfites, carbonyl-bisulfic acid adduct or sulfinic acid compounds described in European Patent No. 294769A are preferable. Further, it is preferable to add various aminopolycarboxylic acids or organic phosphonic acids (e.g., 1-hydroxyethylidene-1,1-diphosphonic acid and N,N,N',N'-ethylenediaminetetraphosphonic acid) in the fixing solution and the bleach-fix solution for the purpose to stabilize the solution.

Further, in the fixing solution and the bleach-fixing solution, various fluorescent brightening agents, antifoamers, surface-active agents, poly(vinyl pyrrolidone), and methanol can be included.

In the bleaching solution, the bleach-fix solution, and/or bath preceding them, various compounds may be used as a bleach-accelerating agent, according to a need. As specific examples of useful bleach-accelerating agents, use can be made of, for example, compounds having a mercapto group or a disulfido group, described in U.S. Pat. No. 3,893,858, West German Patent No. 1,290,812, and JP-A No. 95630/1978, and *Research Disclosure* No. 17129 (July 1978), thiazolizine compounds described in JP-A No. 140129/1975, thiourea compounds described in U.S. Pat. No. 3,706,561, iodide salts described in JP-A No. 16235/1983, polyoxyethylene compounds described in West German Patent No. 2,748,430, polyamine compounds described in JP-B No. 8836/70, and bromide ions. Among them, compounds having a mercapto group or disulfide group are preferable in view of large accelerating effect, in particular, compounds described in U.S. Pat. No. 3,893,858, West German Patent No. 1,290,812, and JP-A No. 95630/1978 are preferable. Further, the compound described in U.S. Pat. No. 4,552,834 is also preferable. These bleach-accelerating agents may be added in the photographic material. These bleach-accelerating agents are particularly effective for bleach-fixing a color photographic material for photography.

The shorter the total time of the desilvering step is, the more preferable it is within the range wherein silver retention does not occur. Preferably it is 5 sec to 2 min, more preferably 10 sec to 1 min. The processing temperature is 25° to 50° C., preferably 35° to 45° C. In the preferable temperature range, the desilvering speed is improved and occurrence of stain after the processing is effectively prevented.

In the desilvering step, preferably the stirring is enhanced as much as possible. Specific techniques for enhancing the stirring that can be mentioned include a method described in JP-A No. 183460/1987 or No. 183461/1987, wherein a jet of a processing liquid is caused to impinge upon the emulsion surface of a photographic material; a method described in JP-A No. 183461/1987, wherein a rotating means is used for increasing the stirring effect; a method wherein a photographic material is moved with a wiper blade provided in a liquid in contact with the emulsion surface, to make the liquid near the emulsion surface turbulent, thereby improving the stirring effect; and a method wherein the circulated flow rate of all the processing liquid is increased. Such a means of improving stirring is effective for any of a bleaching solution, a bleach-fix solution, and a fixing solution. It is considered that the improvement of stirring quickens the supply of a bleaching agent and a fixing agent into emulsion layers, and as a result the speed of desilvering is increased. Further when a bleach accelerator is used, the above means of improving stirring is more effective, increases the accelerating effect noticeably; and it can cancel the fixing-hindrance effect of the bleach accelerator.

The automatic processor to be used for the photographic material according to the present invention is preferably provided with a photographic material transporting means described in JP-A Nos. 191257/1985, 191258/1985, and 191259/1985. As is described in JP-A No. 191257/1985, such a transporting means can reduce considerably the carry-in of the processing liquid from a preceding bath to the succeeding bath, and it is high in the effect of preventing the performance of the processing liquid from being deteriorated. Such an effect is particularly efficacious in shortening the processing time in each step and in reducing the replenishing amount of the processing liquid.

The processing of the present invention exhibits an excellent performance compared with combination methods other than the present invention at any state of opened surface ratio of processing solution. Herein, the opened surface ratio is represented as follows:

Opened surface ratio ($cm^{-1}$) = (Contact surface area ($cm^2$) of the processing solution with the air)/ (Whole volume ($cm^3$) of the processing solution)

However, the opened surface ratio is preferably 0 to 0.1 $cm^{-1}$, in view of the stability of solution constituents. In the continuous processing, for a practical use, the opened surface ratio is preferably in the range from 0.001 to 0.05 $cm^{-1}$, more preferably in the range from 0.002 to 0.03 $cm^{31\ 1}$.

Generally, the color photographic material of the present invention is subjected to a washing step after the desilvering process. Instead of the washing step, a stabilizing step can be carried out. In such a stabilizing process, any of known methods described in JP-A Nos. 8543/1982, 14834/1983, and 220345/1985 can be used. A washing step/stabilizing step, wherein a stabilizing bath containing a dye stabilizer and a surface-active agent that is typically used for processing a photographing color photographic material is used as a final bath, can be carried out.

The washing solution and the stabilizing solution can contain a water softener, such as an inorganic phosphoric acid, polyaminocarbonic acid and an organic aminophosphonic acid; a metal salt such as an Mg salt, an Al salt, and a Bi salt; a surface-active agent; and a hardening agent.

The amount of washing water in the washing step can be set over a wide range, depending on the characteristics of the photographic material (e.g., the characteristics of the material used, such as couplers), the usage of the photographic material, the washing water temperature, the number of the washing water tanks (stages), the type of replenishing, such as the countercurrent type or of the down flow type, and other various conditions. Further, to solve such problems as the propagation of bacteria when the amount of washing water is decreased greatly at a countercurrent flow system and the adhering of suspended matter to the photographic material, the method for reducing calcium ions and magnesium ions, described in JP-A No. 288838, can be used quite effectively. Also, isothiazolone compounds and cyabendazoles described in JP-A No. 8542/1982, chlorine-type disinfectant such as chlorinated sodium isocyanurate, benzotriazoles, and other bactericides described by Hiroshi Horiguchi in *Bokin Bobai-zai no Kagaku,* (1986) published by Sankyo-Shuppan, *Biseibutsu no Mekkin, Sakkin, Bobaigijutsu* (1982) edited by Eiseigijutsu-kai, published by Kogyo-Gijutsu-kai, and in *Bokin Bobaizai Jiten* (1986) edited by Nihon Bokin Bobai-gakkai, can be used.

The pH of the washing water used in the washing step is 4 to 9, preferably 5 to 8. The washing water temperature and the washing time to be set may vary depending, for example, on the characteristics and the application of the photographic material, and they are generally selected in the range of 15° to 45° C. for 10 sec to 5 min, and preferably in the range of 25° to 40° C. for 15 sec to 2 min.

As dye-stabilizing agents to be able to use in a stabilizing solution, aldehydes such as formalin and gultalaldehyde, N-methylol compounds, hexamethylenetetramine, and aldehyde-sulfic acid adduct can be mentioned. Further, the stabilizing solution can contain pH controlling buffer, such as boric acid and sodium hydride, 1-hydroxyethylidene-1, 1-diphosphonic acid, chelating agent, such as ethylenediaminetetraacettic acid, sulfulation-preventer, such as alkanolamine, fluorescent brightening agent, and antimold agent.

The over-flowed solution due to the above-mentioned replenishing of washing solution and/or stabilizing solution may be reused in other steps, such as a desilvering step.

In the processing using an automatic processor, it is preferable to correct the concentration of processing solution by adding water when concentration due to evaporation occurs.

In the present invention, a so-called jet-stream process can be carried out for water-washing solution and/or stabilizing solution, and/or any arbitrary processing solution. The stream can be generated by discharging the processing solution against the emulsion surface of photographic material through a nozzle or a slit provided at the position being opposite to the emulsion surface, which processing solution has been suctioned by a pump in the processing bath. More specifically, the method described in JP-A No. 183460/1987 p. 3 (lower right column) to p. 4 (lower right column), wherein the solution pressed and forwarded by a pump is discharged through a slit or a nozzle provided so as to be opposite to the emulsion surface.

In the present invention, an washing water and/or a stabilizing water treated by a reverse osmosis membrane can be used effectively. As the raw material of the reverse osmosis membrane, cellulose acetate, crosslinked polyamide, polyether, polysyllabic, polyacrylic acid, polyvinylenecarbonate, or the like can be used.

The pressure of solution to be used for these membrane is preferably 2 to 10 kg/cm$^2$, more preferably 3 to 7 kg/cm$^2$, in view of preventing stain and decrease of amount of permeated solution.

The water-washing process and/or stabilizing process are preferably carried out in a multistage-countercurrent mode using multiple tanks, particularly preferably using 2 to 5 tanks.

The treatment by a reverse osmosis membrane is preferably conducted to the water after the second tank in said multistage countercurrent washing process and/or stabilizing process. Concretely, water in the second tank in a 2-tanks constitution, water in the second or third tank in a 3-tanks constitution, or water in the third or fourth tank in a 4-tanks constitution is treated by a reverse osmosis membrane, and the water permeated is returned to the same tank (from which tank water to be treated was withdrawn) or a tank afterward positioned in the washing and/or stabilizing process. Further, in one response to the reverse osmosis treatment, the concentrated washing solution and/or stabilizing solution are fed back to the preceding bleach-fix bath.

As a means of rapid drying of the photographic material, conventionally, control of drying conditions in the drying part, such as the temperature, humidity, and volume of air blown; contrivance of blowing and/or exhausting method; or energy supplying from two or more sources, such as infrared rays and high-frequency heating, are conducted as described in, for example, JP-A Nos. 49760/1988, 274955/1988, 132240/1983, 153653/1986, and 123236/1989. Methods described in JP-A Nos. 134665/1991 and 157650/1991 are also preferably used.

In the present invention, although the time and temperature of drying process may be suitably set, the time is preferably 5 sec to 1 min, and the temperature is preferably 40° to 90° C.

The silver halide color photographic material of the present invention may contain therein a color-developing agent for the purpose of simplifying and quickening the process. To contain such a color-developing agent, it is preferable to use a precursor for color-developing agent. For example, indoaniline-type compounds described in U.S. Pat. No. 3,342,597, Schiff base-type compounds described in U.S. Pat. No. 3,342,599 and *Research Disclosure* Nos. 14850 and 15159, aldol compounds described in *Research Disclosure* No. 13924, and metal salt complexes described in U.S. Pat. No. 3,719,492, and urethane-type compounds described in JP-A No. 135628/1978 can be mentioned.

For the purpose of accelerating the color development, the silver halide color photographic material of the present invention may contain, if necessary, various 1-phenyl-3-pyrazolidones. Typical compounds are described in JP-A Nos. 64339/1981, 144547/1982, and 115438/1983.

According to the method of the present invention, the processing fluctuation, particularly the fluctuation of Dmax, is low, and an image high in sharpness can be provided.

According to the method of the present invention, stain is suppressed and an image high in sharpness is provided. Particularly even when the replenishment rate of a developer is decreased, the above effects could have been attained by the method of the present invention.

Next, the present invention will be described in detail in accordance with examples.

EXAMPLE 1

Preparation of Photographic Material A

A multilayer color print paper having layer compositions shown below was prepared by coating various photographic constituting layers on a paper support laminated on both sides thereof with polyethylene film, followed by subjecting to a corona discharge treatment on the surface thereof and provided a gelatin prime coat layer containing sodium dodecylbenzene sulfonate, and it was designated as Sample A. Coating solutions were prepared as follows:

Preparation of the First Layer Coating Solution 153.0 Grams of yellow coupler (ExY), 15.0 g of image-dye stabilizer (Cpd-1), 7.5 g of image-dye stabilizer (Cpd-2), 16.0 g of image-dye stabilizer (Cpd-3) were dissolved in 25 g of solvent (Solv-1), 25 g of solvent (Solv-2), and 180 ml of ethyl-acetate, and the resulting solution was dispersed and emulsified in 1,000 ml of 10% aqueous gelatin solution containing 60 ml of 10% sodium dodecylbenzenesulfonate solution and 10 g of citric acid, thereby prepared emulsified dispersion A.

Separately silver chlorobromide emulsion A (cubic grains, 3:7 (silver mol ratio) blend of large size emulsion having 0.88 μm of average grain size and small size emulsion having 0.70 μm of average grain size, and 0.08 and 0.10 of deviation coefficient of grain size distribution, respectively, each in which 0.3 mol % of silver bromide was located at a part of grain surface, wherein other silver halide than silver bromide was silver chloride) was prepared. Blue-sensitive sensitizing dyes A and B, shown below, were added in amounts of dyes that corresponds to $2.0\times10^{-4}$ mol and $2.5\times10^{-4}$ mol to the large size emulsion and small size emulsion, per mol of silver, respectively. The chemical sensitizing of this emulsion was carried out by adding sulfur sensitizing agent and gold sensitizing agent.

The above-described emulsified dispersion A and this silver chlorobromide emulsion A were mixed together and dissolved to give the composition shown below, thereby preparing the first layer coating solution.

Preparation of Coating Solutions for the Second to Seventh Layer

Coating solutions for the second to seventh layers were also prepared in the same manner as the coating solution of first layer.

Photographic material Sample A having layer composition shown below were prepared by coating the above-described each layer coating solution.

As a gelatin hardener for the respective layers, 1-oxy-3, 5-dichloro-s-triazine sodium salt was used.

Further, Cpd-14 and Cpd-15 were added in each layer in such amounts that the respective total amount becomes 25.0 mg/m$^2$ and 50.0 mg/m$^2$.

Spectral sensitizing dyes shown below were used in respective silver chlorobromide emulsions of photosensitive emulsion layers.

Blue-sensitive emulsion layer:

Sensitizing dye A

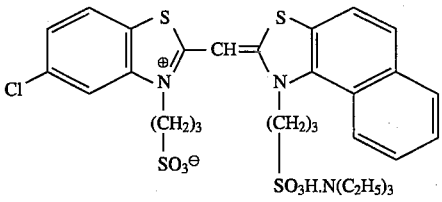

and

Sensitizing dye B

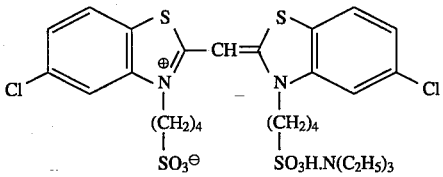

(each $2.0\times10^{-4}$ mol to the large size emulsion and $2.5\times10^{-4}$ mol to the small size emulsion, per mol of silver halide.)

Green-sensitive emulsion layer:

Sensitizing dye C

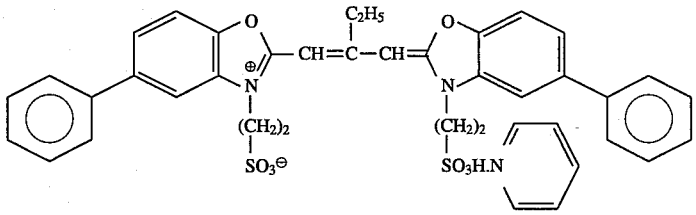

($4.0\times10^{-4}$ mol to the large size emulsion and $5.6\times10^{-4}$ mol to the small size emulsion, per mol of silver halide)

-continued and

Sensitizing dye D

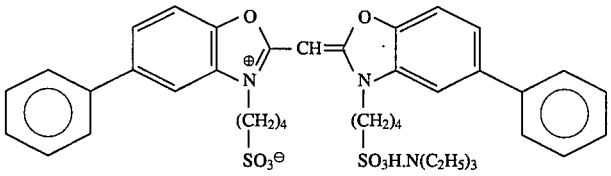

($7.0\times10^{-5}$ mol to the large size emulsion and $1.0\times10^{-5}$ mol to the small size emulsion, per mol of silver halide)

Red-sensitive emulsion layer:

Sensitizing dye E

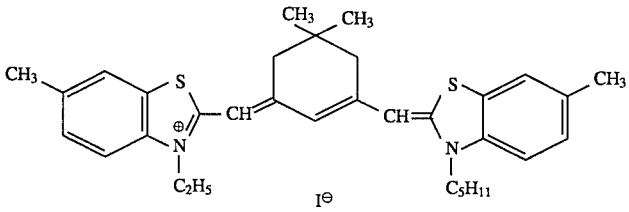

($0.9\times10^{-4}$ mol to the large size emulsion and $1.1\times10^{-4}$ mol to the small size emulsion, per mol of silver halide)

To the red-sensitive emulsion layer, the following compound was added in an amount of $2.6\times10^{-3}$ mol per mol of silver halide:

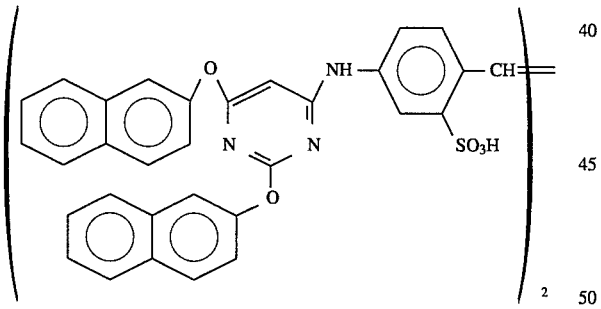

Further, 1-(5-methylureidophenyl)-5-mercaptotetrazole was added to the blue-sensitive emulsion layer, the green-sensitive emulsion layer, and the red-sensitive emulsion layer in amount of $8.5\times10^{-5}$ mol, $7.0\times10^{-4}$ mol, and $2.5\times10^{-4}$ mol, per mol of silver halide, respectively.

Further, 4-hydroxy-5-methyl-1,3,3a,7-tetrazaindene was added to the blue-sensitive emulsion layer and the green-sensitive emulsion layer in amount of $1\times10^{-4}$ mol and $2\times10^{-4}$ mol, per mol of silver halide, respectively.

The dyes shown below (figure in parentheses represents coating amount) were added to the emulsion layers for prevention of irradiation.

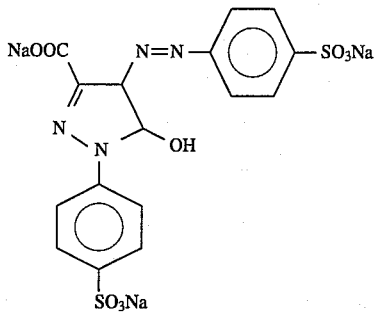

(10 mg/m²)

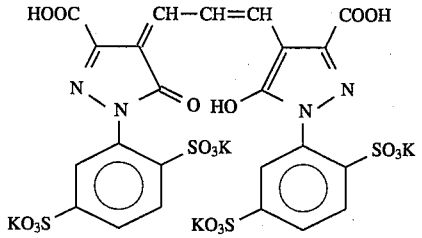

(10 mg/m²)

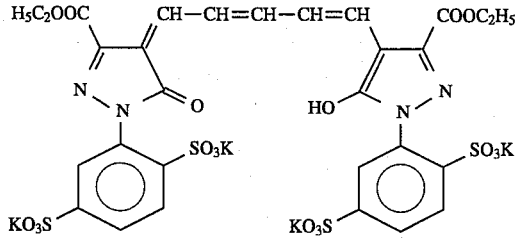

(40 mg/m²)

and

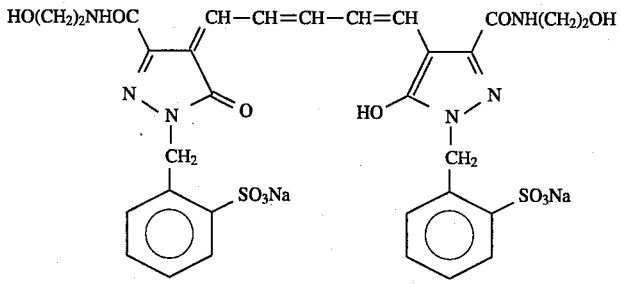

(20 mg/m²)

Composition of Layers

The composition of each layer is shown below. The figures represent coating amount (g/m²). The coating amount of each silver halide emulsion is given in terms of silver.

| | |
|---|---|
| Supporting Base | |
| Paper laminated polyethylene (a white pigment, $TiO_2$, and a bluish dye, ultramarine, were included in the first layer side of the polyethylene-laminated film) | |
| First Layer (Blue-sensitive emulsion layer) | |
| The above described silver chlorobromide emulsion A | 0.27 |
| Gelatin | 1.36 |
| Yellow coupler (ExY) | 0.79 |
| Image-dye stabilizer (Cpd-1) | 0.08 |
| Image-dye stabilizer (Cpd-2) | 0.04 |
| Image dye stabilizer (Cpd-3) | 0.08 |
| Solvent (Solv-1) | 0.13 |
| Solvent (Solv-2) | 0.13 |

-continued

| | |
|---|---|
| Second Layer (Color-mix preventing layer) | |
| Gelatin | 0.80 |
| Color mix inhibitor (Cpd-4) | 0.06 |
| Solvent (Solv-7) | 0.03 |
| Solvent (Solv-2) | 0.25 |
| Solvent (Solv-3) | 0.25 |
| Third Layer (Green-sensitive emulsion layer) | |
| Silver chlorobromide emulsion B (cubic grains, 1:3 (Ag mol ratio) blend of large size emulsion having average grain size of 0.55 μm and small size emulsion having average grain size of 0.39 μm, whose deviation coefficient of grain size distribution is 0.10 and 0.08, respectively, each in which emulsion 0.8 mol % of silver bromide was located at a part of grain surface, wherein silver halide other than silver bromide was silver chloride) | 0.13 |
| Gelatin | 1.45 |
| Magenta coupler (ExM) | 0.16 |
| Image-dye stabilizer (Cpd-5) | 0.15 |
| Image-dye stabilizer (Cpd-2) | 0.03 |
| Image-dye stabilizer (Cpd-6) | 0.01 |
| Image-dye stabilizer (Cpd-7) | 0.01 |
| Image-dye stabilizer (Cpd-8) | 0.08 |
| Solvent (Solv-3) | 0.50 |
| Solvent (Solv-4) | 0.15 |
| Solvent (Solv-5) | 0.15 |
| Fourth Layer (Color-mix preventing layer) | |
| Gelatin | 0.65 |
| Color-mix inhibitor (Cpd-4) | 0.04 |
| Solvent (Solv-7) | 0.02 |
| Solvent (Solv-2) | 0.18 |
| Solvent (Solv-3) | 0.18 |
| Fifth Layer (Red-sensitive emulsion layer) | |
| Silver chlorobromide emulsion C (cubic grains, 1:4 (Ag mol ratio) blend of large size emulsion having average grain size of 0.50 μm and small size emulsion having average grain size of 0.41 μm, whose deviation coefficient of grain size distribution is 0.09 and 0.11, respectively, each in which emulsion 0.8 mol % of silver bromide was located at a part of grain surface, wherein silver halide other than above silver bromide is silver chloride) | 0.18 |
| Gelatin | 0.80 |
| Cyan coupler (ExC) | 0.33 |
| Image-dye stabilizer (Cpd-1) | 0.35 |
| Ultraviolet absorber (UV-2) | 0.18 |
| Image-dye stabilizer (Cpd-9) | 0.15 |
| Image-dye stabilizer (Cpd-10) | 0.15 |
| Image-dye stabilizer (Cpd-11) | 0.01 |
| Solvent (Solv-6) | 0.22 |
| Image-dye stabilizer (Cpd-8) | 0.01 |
| Image-dye stabilizer (Cpd-6) | 0.01 |
| Solvent (Solv-1) | 0.01 |
| Sixth Layer (Ultraviolet absorbing layer) | |
| Gelatin | 0.55 |
| Ultraviolet absorber (UV-1) | 0.38 |
| Image-dye stabilizer (Cpd-12) | 0.15 |
| Image-dye stabilizer (Cpd-5) | 0.02 |
| Seventh Layer (Protective layer) | |
| Gelatin | 1.13 |
| Acryl-modified copolymer of polyvinyl alcohol (modification degree: 17%) | 0.05 |
| Liquid paraffin | 0.02 |
| Image-dye stabilizer (Cpd-13) | 0.01 |

-continued
(ExY) Yellow coupler
Mixture ((a):(b) = 1:1 in molar ratio) of
(a) R = 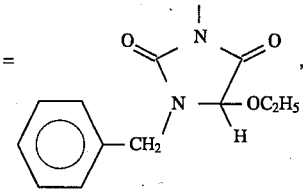 , X = Cl;
(b) R = 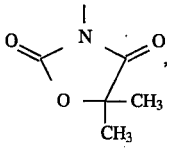 , X = $OCH_3$
of the following formula
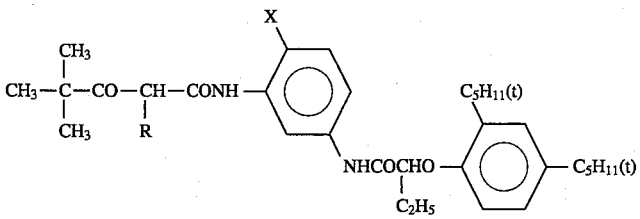
(ExM) Magenta coupler
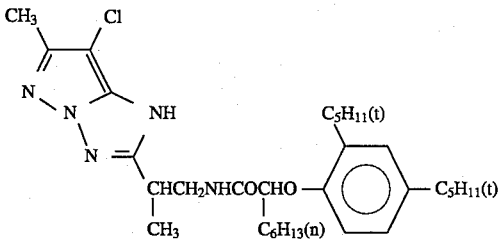
(ExC) Cyan coupler
Mixture (3:7 in molar ratio) of
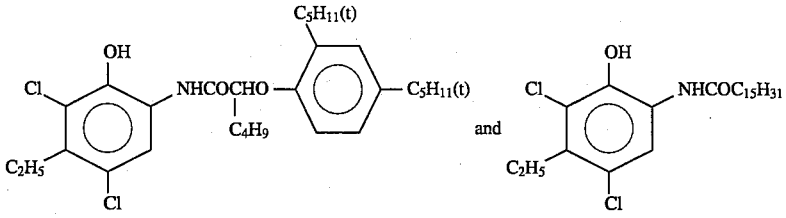
(Cpd-1) Image-dye stabilizer
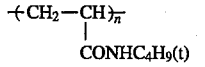
Av. molecular weight: 60,000
(Cpd-2) Image-dye stabilizer
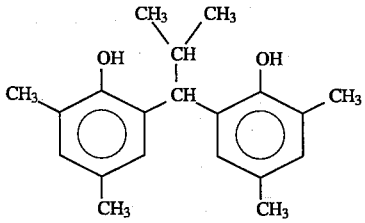

-continued
(Cpd-3) Image-dye stabilizer
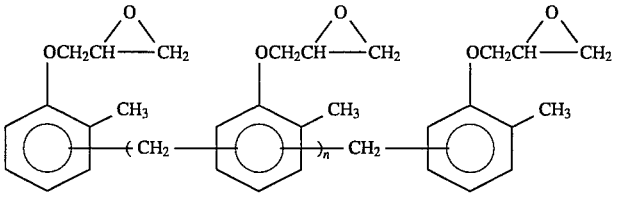
n = 7–8 (in average)
(Cpd-4) Color-mix inhibitor
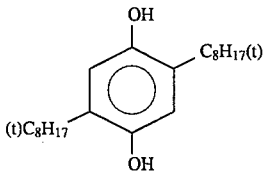
(Cpd-5) Image-dye stabilizer
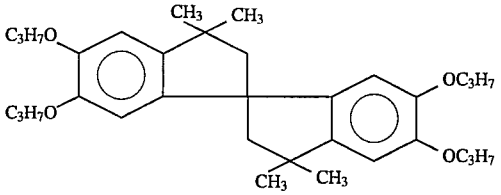
(Cpd-6) Image-dye stabilizer
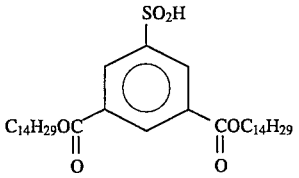
(Cpd-7) Image-dye stabilizer
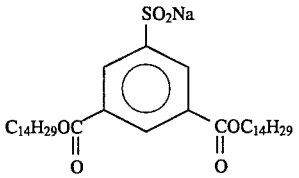
(Cpd-8) Image-dye stabilizer
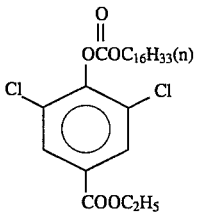
(Cpd-9) Image-dye stabilizer
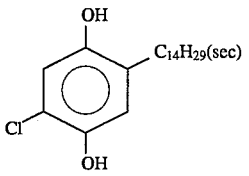
(Cpd-10) Image-dye stabilizer
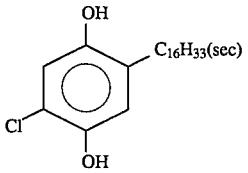
(Cpd-11) Image-dye stabilizer
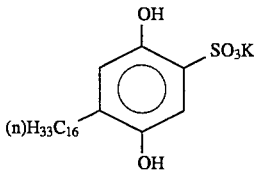
(Cpd-12) Image-dye stabilizer
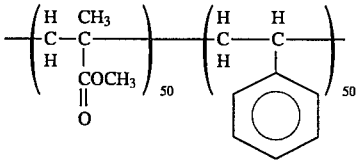
Av. molecular weight: 60,000

-continued
(Cpd-13) Image-dye stabilizer
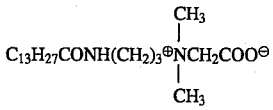
(Cpd-14) Antiseptic
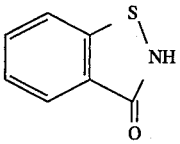
(Cpd-15) Antiseptic
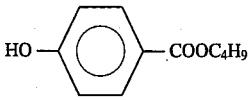
(UV-1) Ultraviolet ray absorber
Mixture of (i), (ii), (iii), and (iv) (1:5:10:5 in weight ratio)
(i)
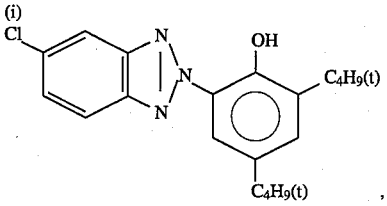
(ii)
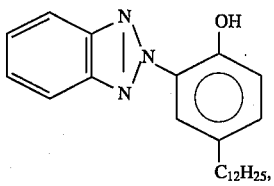
(iii)
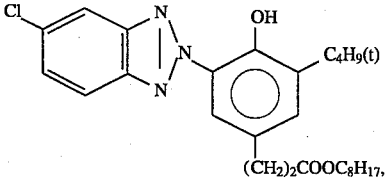
and
(iv)
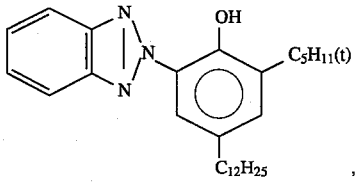
(UV-2) Ultraviolet ray absorber
Mixture of (1), (2), and (3) (1:2:2 in weight ratio)
(1)
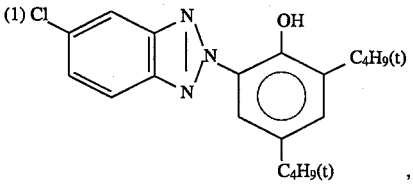
(2)
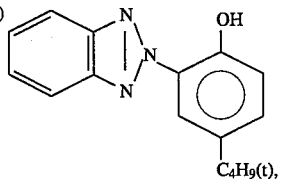
and
(3)
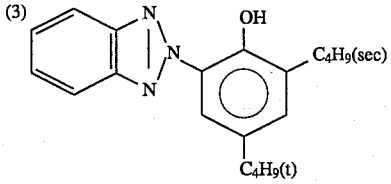
(Solv-1) Solvent
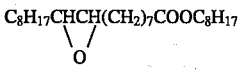
(Solv-2) Solvent
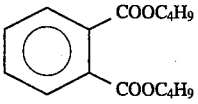
(Solv-3) Solvent
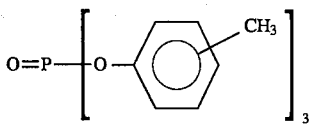
(Solv-4) Solvent
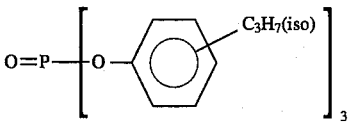

-continued (Solv-5) Solvent $O{=}P{-}(OCH_2CH(C_2H_5)C_4H_9(n))_3$ (Solv-6) Solvent

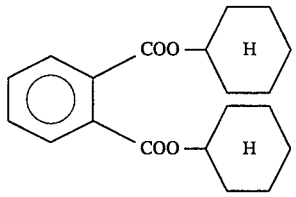

(Solv-7) Solvent

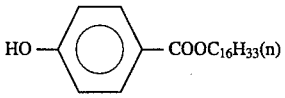

Photosensitive Material B having a constitution of the present invention was prepared in the same manner as for Photosensitive Material A, except that the following layers were arranged.

That is, the below-given white pigment-containing hydrophilic colloid dispersion was applied between the polyethylene laminated paper that was a support and the first layer so that the $TiO_2$ might be 2.5 g/m$^2$.

White Pigment-Containing Colloidal Dispersion

400 Grams of rutile type titanium white pigment having an average grain size of 0.23 μm (Titan White R780 manufactured by Ishihara Sangyo KK) and 4 liter of water were added to 1.0 kg of a 10% aqueous gelatin solution, then 8 ml of a 5% aqueous sodium dodecylbenzenesulfonate was added thereto as a dispersant, and the mixture was subjected to ultrasonic waves to disperse the pigment.

The thus prepared Samples were cut and were given gradation exposure of a color separation filter for sensitometry by using a sensitometer (manufactured by Fuji Photo Film Ltd., Co.; FW type; the color temperature of the light source: 3200° K.).

Further, in order to evaluate the sharpness, a rectangular pattern deposited on a glass substrate and having a density difference of 0.5 with the spatial frequency varied was brought in firm contact with each Sample and the Sample was exposed to light and was processed with the following solutions and in the following processing steps.

The exposure for the evaluation of the sharpness was carried out through a green filter so that the development of the color could be sensed with the human eyes.

| Processing step | Temperature | Time | Replenisher* | Tank Volume |
|---|---|---|---|---|
| Color developing | 38–42° C. | 25 sec | See below | 2 liter |
| Bleach-fixing | 40° C. | 15 sec | 50 ml | 2 liter |
| Rinse (1) | 40° C. | 5 sec | — | 1 liter |
| Rinse (2) | 40° C. | 5 sec | — | 1 liter |
| Rinse (3) | 40° C. | 5 sec | — | 1 liter |
| Rinse (4) | 40° C. | 5 sec | — | 1 liter |
| Rinse (5) | 40° C. | 15 sec | 100 ml | 1 liter |
| Drying | 60–80° C. | 15 sec | | |

Note: *Replenisher amount per m$^2$ of photographic

Water from rinse (5) was pressurized and fed to reverse osmosis membrane, and the permeated water was fed to rinse (5), while the concentrated water which had not permeated through the membrane was returned to rinse (4) and reused.

The composition of each processing solution is as followed, respectively:

| Color-developer | |
|---|---|
| (First replenisher) | |
| N-Ethyl-N-(β-methanesulfonamidoethyl)-3-methyl-4-aminoaniline 3/2 sulfate monohydrate | 9.5 g |
| Sulfinate (Compound S-1) | 0.003 mol |
| Disodium 1,2-dihydroxybenzene-4,6-disulfonate | 0.5 g |
| Water to make | 100 ml |
| pH (25° C.) | 3.5 |
| (Second replenisher) | |
| Triethanolamine | 8.0 g |
| Disodium N,N-bis(Sulfonatoethyl)-hydroxylamine | 4.6 g |
| Sodium Triisopropylnaphthalene-(β)sulfonate | 0.1 g |
| Ethylenediaminetetraacetic acid | 2.0 g |
| Fluorescent whitening agent (UVITEX CK, made by Ciba Geigy) | 0.5 g |
| Potassium carbonate | 16.0 g |
| Water to make | 200 ml |
| pH (25° C.) | 13.4 |
| Color developer (Tank solution) | |
| First replenisher | 100 ml |
| Second replenisher | 200 ml |
| Potassium carbonate | 15 g |
| KCl | See Table 1 |
| KBr | 0.03 g |
| Water to make | 1,000 ml |
| pH (25° C.) | 10.35 |
| Replenishing amount of first replenisher: per m$^2$ of photographic material | 12.4 ml, |
| Replenishing amount of second replenisher: per m$^2$ of photographic material | 20.0 ml, |

| Bleach-fixing solution | (Tank solution) |
|---|---|
| Water | 500 ml |
| Ammonium thiosulfate (700 g/l) | 100 ml |
| Ammonium sulfite | 40 g |
| Iron (III) ammonium ethylenediaminetetraacetate | 77 g |
| Disodium ethylenediaminetetraacetate | 5 g |
| Ammonium chloride | 42 g |
| Acetic acid (50%) | 25 ml |
| Water to make | 1,000 ml |
| pH (25° C.) | 5.8 |
| (pH was adjusted by acetic acid and aqueous ammonium) | |
| (Replenisher was prepared in the same composition as the above, except that pH was adjusted to 5.0) | |

Rinse Solution

Tap water was used.

With respect to the Photographic Materials, the sensitivity of the yellow layer that was the lowermost layer was evaluated as the processing fluctuation. That is, the fluctuation of the sensitivity of the blue-sensitive emulsion layer that was obtained when the development processing temperature was changed from 38° to 42° C. was evaluated relatively.

With respect to the sharpness, the obtained rectangular image was measured precisely by a microdensitometer and a spatial frequency of 3 cycle/mm where the CTF (contrast transfer function) value became 0.5 was determined and was used as the scale of the sharpness.

The results are shown in Table 1.

TABLE 1

| Test No. | Photo-graphic material | Amount of KCl in color developer (mol/liter) | Temperature at developing (°C.) | Yellow relative sensitivity | Sharpness CTF value | Remarks |
|---|---|---|---|---|---|---|
| 1-1 | A | 0.02 | 38 | 0.00 | 13.5 | Comparison |
| 1-2 | " | " | 40 | 0.02 | 13.5 | " |
| 1-3 | " | " | 42 | 0.04 | 13.5 | " |
| 1-4 | " | 0.04 | 38 | 0.00 | 13.5 | " |
| 1-5 | " | " | 40 | 0.02 | 13.5 | " |
| 1-6 | " | " | 42 | 0.04 | 13.5 | " |
| 1-7 | B | 0.02 | 38 | 0.01 | 19.0 | " |
| 1-8 | " | " | 40 | 0.04 | 19.0 | " |
| 1-9 | " | " | 42 | 0.09 | 19.0 | " |
| 1-10 | " | 0.04 | 38 | 0.00 | 19.2 | This Invention |
| 1-11 | " | " | 40 | 0.02 | 19.2 | " |
| 1-12 | " | " | 42 | 0.04 | 19.2 | " |
| 1-13 | " | 0.25 | 38 | 0.00 | 19.5 | " |
| 1-14 | " | " | 40 | 0.015 | 19.5 | " |
| 1-15 | " | " | 42 | 0.030 | 19.5 | " |
| 1-16 | " | 0.40 | 38 | −0.08 | 19.2 | Comparison |
| 1-17 | " | " | 40 | −0.04 | 19.2 | " |
| 1-18 | " | " | 42 | 0.01 | 19.2 | " |

With respect to the yellow relative sensitivity, the sensitivity of Test No. 1-1 was used as a standard and the deviation therefrom was shown by the logarithm (log E value).

As is apparent from Table 1, the constitution according to the present invention shows excellent sharpness. However, where the chloride ion concentration in the color developer is low, the sensitivity of yellow (blue-sensitive layer) changes readily due to the change of the development temperature. It can be understood that even where the chloride ion concentration is too high, the sensitivity is unpreferably greatly lowered when the width of the fluctuation of the sensitivity increases.

It can be understood that, in the chloride ion concentration range of the present invention (0.04 to 0.25 mol/l), the fluctuation of the sensitivity due to the processing temperature is low and an improvement of sharpness can be attained.

EXAMPLE 2

Using Photographic Material B of Example 1, Example 1 was repeated, except that the following processing solutions and processing steps were used. After the Samples were exposed to light, they are continuously processed by using the following processing steps and color developer composition until the color developer was replenished in an amount corresponding to the volume of the tank (running test).

| Processing step | Temperature | Time | Reple-nisher* | Tank Volume |
|---|---|---|---|---|
| Color developing | 40° C. | 15 sec | 35 ml | 2 liter |
| Bleach-fixing | 40° C. | 15 sec | 35 ml | 2 liter |
| Rinse (1) | 40° C. | 3 sec | — | 1 liter |
| Rinse (2) | 40° C. | 3 sec | — | 1 liter |
| Rinse (3) | 40° C. | 3 sec | — | 1 liter |
| Rinse (4) | 40° C. | 3 sec | — | 1 liter |
| Rinse (5) | 40° C. | 6 sec | 60 ml | 1 liter |
| Drying | 60–80° C. | 15 sec | | |

Note: *Replenisher amount per $m^2$ of photographic material. Rinsing steps were carried out in 5-tanks countercurrent mode from the tank of rinsing (5) toward the tank of rinsing (1).

In the above-described processing, water from rinse (5) was pressurized and fed to reverse osmosis membrane, and the permeated water was fed to rinse (5), while the concentrated water which had not permeated through the membrane was returned to rinse (4) and reused. Further, In order to shorten the cross-over time between each rinse step, blade was provided between respective rinse bathes through-which the photographic material passed.

The composition of each processing solution is

| Color-developer | Tank solution | Reple-nisher |
|---|---|---|
| Water | 700 ml | 700 ml |
| Ethylenediaminetetraacetic acid | 1.5 g | 3.75 g |
| Sodium triisopropylnaphthalene-(β) sulfonate | 0.01 g | 0.01 g |
| Disodium 1,2-dihydroxybenzene-4,6-disulfonate | 0.25 g | 0.7 g |
| Triethanolamine | 5.8 g | 14.5 g |
| Potassium chloride | (See Table 2) | |
| Potassium bromide | 0.03 g | — |
| Potassium carbonate | 30.0 g | 39.0 g |
| Fluorescent whitening agent (UVITEX CK, made by Ciba Geigy Co.) | 2.5 g | 5.0 g |
| Sodium sulfite | 0.14 g | 0.2 g |
| Disodium N,N-bis(sulfonatoethyl)-hydroxylamine | 7.4 g | 15.0 g |
| 4-Amino-3-methyl-N-ethyl-N-(4-hydroxy-butyl)-aniline.2p-toluenesulfonic acid | 14.5 g | 35.0 g |

-continued

| | | |
|---|---|---|
| Water to make | 1000 ml | 1000 ml |
| pH (25° C.) | 10.05 | 10.45 |

| Bleach-fixing solution | Tank solution |
|---|---|
| Water | 600 ml |
| Ammonium thiosulfate (700 g/l) | 100 ml |
| Ammonium sulfite | 40 g |
| Iron (III) ammonium ethylenediaminetetraacetate | 77 g |
| Disodium ethylenediaminetetraacetate | 5 g |
| Ammonium bromide | 10 g |
| Ethylenebisguanidine sulfonate | 12 g |
| Acetic acid (50%) | 25 ml |
| Water to make | 1000 ml |
| pH (25° C.) | 5.5 |
| (pH was adjusted by acetic acid and aqueous ammonium) | |
| (Replenisher was prepared in the same composition as the above, except that pH was adjusted to 5.0) | |
| **Rinse solution** | |
| (Both tank solution and replenisher) Ion-exchanged water (calcium and magnesium each are 3 ppm or below) | |

TABLE 2

| Test No. | Amount of KCl in color developer (mol/liter) | Temperature at developing (°C.) | Yellow relative sensitivity* | Sharpness CTF value | Remarks |
|---|---|---|---|---|---|
| 2-1 | 0.02 | 38 | 0.00 | 19.6 | Comparison |
| 2-2 | " | 40 | 0.03 | 19.6 | " |
| 2-3 | " | 42 | 0.08 | 19.6 | " |
| 2-4 | 0.15 | 38 | 0.00 | 19.8 | This Invention |
| 2-5 | " | 40 | 0.01 | 19.8 | " |
| 2-6 | " | 42 | 0.02 | 19.8 | " |

Note; *Sensitivity is shown by logarithm (log E value) of each sensitivity deviation from that of Test No.2-1, which is used as a standard.

As is apparent from the results in Table 2, an image having a high sharpness and low degree of fluctuation of sensitivity due to change of processing temperature can be attained by using a color developer containing chloride ions of which concentration is in the range of the present invention.

Further, when the p-toluenesulfonate of compound I-12 of the present invention is used the fluctuation of sensitivity due to processing temperature can be lowered further.

Next, equally good results were obtained when the processing was carried out by changing compound I-12 to I-2, I-3, or I-7, of the present invention.

EXAMPLE 3

The procedure for the Photographic Material B was repeated, except that the following coloring substance-containing layer a or b was applied on the white pigment-containing hydrophilic colloidal layer containing $TiO_2$ of Photographic Material B prepared in Example 1, thereby preparing the corresponding Photographic Materials.

Example 1 was repeated, except that the developing solution and the processing steps were changed as shown below.

The coloring substance-containing layer A contained, as a coloring substance, colloidal silver prepared in the following manner.

2 Grams of anhydrous sodium carbonate was added to 1,000 g of a 10% aqueous gelatin solution and the temperature was kept at 45° C. Then 500 ml of a 10% aqueous silver nitrate solution was added thereto and then 1,000 ml of an aqueous solution containing 35 g of anhydrous sodium sulfite and 25 g of hydroquinone was added thereto over 10 min. After the completion of the addition, the mixture was allowed to stand for 10 min and 100 ml of 1N sulfuric acid was added to adjust the pH to 5.0. The obtained colloidal sol was poured onto a cooled tray and was allowed to gel well, the gel was cut into the shape of noodles, and the noodles were washed with cold water for 6 hours to desalt to obtain a colloidal silver dispersion.

The coloring substance-containing layer B contained a dispersion of a solid dye prepared in the following manner.

21.7 Milliliter of water, 3.0 ml of a 5% aqueous sodium p-octylphenoxyethoxyethanesulfonate solution, and 0.5 g of p-octylphenoxy polyoxyethylene (degree of polymerization: 10) ether were placed in a 700-ml pot mill, then 1.65 g of Dye D-1 and 500 ml of zirconium beads (having a diameter of 1 mm) were added thereto, and the Dye was dispersed for 2 hours by a vibration ball mill (BO type manufactured by Chuo Kakoki).

Thereafter, the contents were taken out, 8.0 g of a 12.5% aqueous gelatin solution was added thereto, and the beads were removed by filtering to obtain a dispersion of the Dye.

The compositions of these layers were as given below. The color mixing inhibitor and the solvent used were the same as those used in Example 1. The gelatin used in these layers was one from which Ca had been removed.

| | |
|---|---|
| Coloring-substance-containing layer A | |
| Black colloidal silver (in terms of silver) | 0.10 g/m$^2$ |
| Gelatin | 0.99 g/m$^2$ |
| Color-mix inhibitor (Cpd-4) | 0.08 g/m$^2$ |
| Solvent (Solv-1) | 0.16 g/m$^2$ |
| Solvent (Solv-4) | 0.08 g/m$^2$ |
| Coloring-substance-containing layer B | |
| Dye D-1 | 0.06 g/m$^2$ |
| Gelatin | 0.66 g/m$^2$ |
| Intermediate layer | |
| Gelatin | 0.99 g/m$^2$ |
| Color-mix inhibitor (Cpd-4) | 0.08 g/m$^2$ |
| Solvent (Solv-1) | 0.16 g/m$^2$ |
| Solvent (Solv-4) | 0.08 g/m$^2$ |

| Processing step | Temperature | Time | Replenisher* | Tank Volume |
|---|---|---|---|---|
| Color developing | 38–42° C. | 38 sec | 60 ml | 2 liter |

-continued

| | | | | |
|---|---|---|---|---|
| Bleach-fixing | 40° C. | 20 sec | 60 ml | 2 liter |
| Water-washing (1) | 40° C. | 7 sec | — | 1 liter |
| Water-washing (2) | 40° C. | 7 sec | — | 1 liter |
| Water-washing (3) | 40° C. | 7 sec | 120 ml | 1 liter |
| Drying | 70–80° C. | 15 sec | | |

Note: *Replenisher amount per $m^2$ of photographic material. Water-washing steps were carried out in 3-tanks countercurrent mode from the tank of water-washing (3) toward the tank of water-washing (1).

Water from water-washing (2) was pressurized and fed to reverse osmosis membrane, and the permeated water was fed to water-washing (3), while the concentrated water which had not permeated through the membrane was returned to water-washing (2) to use.

The composition of each processing solution is as followed, respectively:

| Color-developer | Tank Solution | Replenisher |
|---|---|---|
| Water | 800 ml | 800 ml |
| Ethylenediamine-N,N,N',N'-tetramethylene phosphanic acid | 1.5 g | 2.0 g |
| Potassium bromide | 0.15 g | — |
| Triethanolamine | 8.0 g | 12.0 g |
| Sodium chloride | 6.5 g | — |
| N-Ethyl-N-(β-methanesulfonamidoethyl)-3-methyl-4-aminoaniline sulfonate | 5.0 g | 9.0 g |
| Sodium N,N-di(sulfoethyl)-hydroxylamine | 4.0 g | 8.0 g |
| Fluorescent whitening agent (WHITEX 4B, made by Sumitomo Chemical Ind. Co.) | 1.0 g | 2.0 g |
| Water to make | 1000 ml | 1000 ml |
| pH (25° C.) | 10.05 | 10.45 |

The results of the evaluation that was carried out in the same manner as in Example 1 showed that the sharpness of the photographic material having colloidal silver applied on a white pigment layer and the sharpness of the photographic material to which a dispersion of a solid dye had been applied were higher than that of Photographic Material B. The change of the fluctuation of the sensitivity due to the change of processing temperature was the same as that of Example 1 by using chloride ions in the range of 0.04 to 0.25 mol/l in the color developer.

EXAMPLE 4

The photographic material, the processing solutions, and the processing method of Example 2 were used to repeat Example 2, except that the replenishing water volume of the rinse (5) (the final bath) used in Example 2 was changed. The replenishing water volume of the rinse (5) was changed and after the running processing was carried out, the concentration of iron in the rinse (5) was measured by atomic absorption spectrometry, and the results are shown in Table 3. The stain densities that were caused by processing with the rinse (5) having respective iron concentrations are shown in Table 3. The stain densities were compared by measuring the absorbances at 450 nm of the spectral reflection density curve.

TABLE 3

| Test No. | Concentration of iron (ppm) | Stain Reflective density at 450 nm | | | |
|---|---|---|---|---|---|
| | | $TiO_2$ (not coated) | $TiO_2$ (1 g/$m^2$) | $TiO_2$ (2.5 g/$m^2$) | $TiO_2$ (5 g/$m^2$) |
| 4-1 | 0.5 | 0.065 (Comparison) | 0.065 (Comparison) | 0.065 (This Invention) | 0.065 (This Invention) |
| 4-2 | 5 | 0.065 (Comparison) | 0.065 (Comparison) | 0.066 (This Invention) | 0.066 (This Invention) |
| 4-3 | 15 | 0.066 (Comparison) | 0.067 (Comparison) | 0.068 (This Invention) | 0.069 (This Invention) |
| 4-4 | 30 | 0.068 (Comparison) | 0.069 (Comparison) | 0.071 (This Invention) | 0.072 (This Invention) |
| 4-5 | 40 | 0.072 (Comparison) | 0.073 (Comparison) | 0.080 (Comparison) | 0.089 (Comparison) |
| 4-6 | 80 | 0.078 (Comparison) | 0.079 (Comparison) | 0.095 (Comparison) | 0.105 (Comparison) |

As a result, it was found that when the iron concentration of the rinse (5) in the final washing bath was brought to more than 30 ppm, the stain density became considerably high and the white background was deteriorated.

Where the replenishing amount of the color developer is small, the above results are liable to occur and are conspicuous when the processing is carried out continuously while the replenishing is carried out whose amount is 0.5 to 4 times the developing solution carried over by the photographic material.

Having described our invention as related to the present embodiments, it is our intention that the invention not be limited by any of the details of the description, unless otherwise specified, but rather be construed broadly within its spirit and scope as set out in the accompanying claims.

What we claim is:

1. A method for processing a silver halide color photographic material having, on a support, at least three photosensitive silver halide emulsion layers, which comprises:

processing, after exposure to light, said silver halide color photographic material with a color developer containing chloride ions in an amount of 0.04 to 0.25 mol/l at a temperature in a range from 30° to 45° C., wherein the silver halide in said emulsion layers contains 90 mol % or more of silver chloride, wherein said support is composed of a paper support having surfaces covered with a water-resistant resin layer, wherein at least the surface of the side upon which the photosensitive silver halide emulsion layers are coated is covered with a water-resistant resin layer containing white pigment fine particles;

wherein said photographic material has a white pigment-containing hydrophilic colloid layer coating on the surface of the water-resistant resin layer that is located on the side of the support upon which the photosensitive silver halide emulsion layers are coated, wherein the coating amount of the white pigment is from 2 to 15 g/$m^2$.

2. The method for processing a silver halide color photographic material as claimed in claim 1, wherein said photographic material is a photographic material further having a hydrophilic colloid layer containing colloidal silver and/or a hydrophilic colloid layer containing a particulate solid dye and/or a hydrophilic colloid layer containing a water-soluble dye.

3. The method for processing a silver halide color photographic material as claimed in claim 1, wherein the silver halide in said emulsion layer contains 90 mol % or more of silver chloride, and said photographic material has a white pigment-containing hydrophilic colloid layer coated on the support, the coating amount of the white pigment being 2 $g/m^2$ or more; the color-developing process comprises color-developing, desilvering, and washing or stabilizing; the replenishment rate for the color developer is 0.5 to 4 times that carried-over from the developing bath; the washing or the stabilizing step is conducted in a multi-stage counter-current fashion; and the iron ion concentration of the final bath is 30 ppm or below.

4. The method for processing a silver halide color photographic material as claimed in claim 1, wherein the color-developing agent to be used in the color developer is a p-phenylenediamine derivative represented by the following formula (Dev):

formula (Dev):

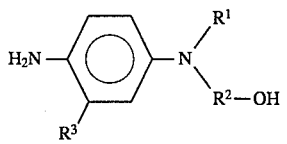

wherein $R^1$ and $R^3$ each represent an alkyl group having 1 to 4 carbon atoms, and $R^2$ represents a straight-chain or branched-chain alkylene group having 3 to 4 carbon atoms.

5. The method for processing a silver halide color photographic material as claimed in claim 1, wherein the processing time from the start of the developing process to the end of the drying process is within 120 sec.

6. The method for processing a silver halide color photographic material as claimed in claim 1, wherein at least one hydrophilic colloid layer of the photographic material contains a colorant capable of being decolored in the development processing.

7. The method for processing a silver halide color photographic material as claimed in claim 1, wherein the concentration of chloride ions contained in said color developer is in the range from 0.075 to 0.2 mol/l.

8. The method for processing a silver halide color photographic material as claimed in claim 3, wherein the replenishment rate for the color developer is 1 to 2 times that carried-over from the developing bath.

9. The method for processing a silver halide color photographic material as claimed in claim 3, wherein the iron ion concentration of the final bath is in the range from 0.5 to 30 ppm.

10. The method for processing a silver halide color photographic material as claimed in claim 1, wherein the coating amount of white pigment contained in said hydrophilic colloid layer is in the range from 2 to 20 $g/m^2$.

11. The method for processing a silver halide color photographic material as claimed in claim 1, wherein the content of white pigment in said hydrophilic colloid layer is 10 to 98 wt. %.

12. The method for processing a silver halide color photographic material as claimed in claim 1, wherein the white pigment in said hydrophilic colloid layer is selected from the group consisting of titanium dioxide, barium sulfate, lithopone, aluminum white, calcium carbonate, silica white, antimony trioxide, titanium phosphate, zinc oxide, white lead, and gypsum.

13. The method for processing a silver halide color photographic material as claimed in claim 1, wherein the white pigment-containing hydrophilic colloid layer is applied between the support and the photosensitive emulsion layer.

14. The method for processing a silver halide color photographic material as claimed in claim 2, wherein the amount of colloidal silver in the colloidal silver-containing layer is 0.01 to 0.5 g, in terms of silver per $m^2$ of the photographic material.

15. The method for processing a silver halide color photographic material as claimed in claim 6, wherein the hydrophilic colloid layer containing a colorant capable of being decolored in the development processing is provided beneath an emulsion layer that will be color-developed to the same primary color as that of the colorant.

16. The method for processing a silver halide color photographic material as claimed in claim 4, wherein the amount of the color-developing agent represented by formula (Dev) is 0.002 to 0.2 mol per liter of said color developer.

17. The method for processing a silver halide color photographic material as claimed in claim 1, wherein said processing comprises a developing bath whereby the iron ion concentration of the final bath is 30 ppm or below.

18. The method of claim 1, wherein at least one of the surfaces covering the paper support is a water-resistant resin layer containing white pigment fine particles.

19. A method for processing a silver halide color photographic material according to claim 1 wherein said support is composed of a paper support having both surfaces covered with a water-resistant resin layer.

* * * * *